US010125335B2

(12) United States Patent
Carrera et al.

(10) Patent No.: US 10,125,335 B2
(45) Date of Patent: Nov. 13, 2018

(54) LUBRICATING COMPOSITIONS CONTAINING ISOPRENE BASED COMPONENTS

(71) Applicant: CASTROL LIMITED, Pangbourne, Reading (GB)

(72) Inventors: Martin E. Carrera, Berkeley, CA (US); John Philip Davies, Pangbourne (GB); Sander Gaemers, Pangbourne (GB); John William Shabaker, Naperville, IL (US); Oliver Williams, Europoort-Rotterdam (NL)

(73) Assignee: CASTROL LIMITED, Swindon, Wiltshire (GB)

( * ) Notice: Subject to any disclaimer, the term of this patent is extended or adjusted under 35 U.S.C. 154(b) by 187 days.

(21) Appl. No.: 14/901,056

(22) PCT Filed: Jun. 27, 2014

(86) PCT No.: PCT/EP2014/063760

§ 371 (c)(1),
(2) Date: Dec. 27, 2015

(87) PCT Pub. No.: WO2014/207235

PCT Pub. Date: Dec. 31, 2014

(65) Prior Publication Data

US 2016/0137945 A1 May 19, 2016

(30) Foreign Application Priority Data

Jun. 28, 2013 (EP) ..... 13174256

(51) Int. Cl.

| | |
|---|---|
| ***C10G 1/10*** | (2006.01) |
| ***C07C 9/15*** | (2006.01) |
| ***C10M 105/00*** | (2006.01) |
| ***C10M 105/18*** | (2006.01) |
| ***C10M 105/32*** | (2006.01) |
| ***C10M 105/04*** | (2006.01) |
| ***C10M 105/36*** | (2006.01) |
| ***C10M 105/08*** | (2006.01) |
| ***C10M 105/34*** | (2006.01) |

(52) U.S. Cl.

CPC ..... *C10M 105/36* (2013.01); *C10M 105/08* (2013.01); *C10M 105/18* (2013.01); *C10M 105/32* (2013.01); *C10M 105/34* (2013.01); *C10M 2203/02* (2013.01); *C10M 2203/0206* (2013.01); *C10M 2203/1006* (2013.01); *C10M 2203/1025* (2013.01); *C10M 2205/0285* (2013.01); *C10M 2207/028* (2013.01); *C10M 2207/04* (2013.01); *C10M 2207/0406* (2013.01); *C10M 2207/281* (2013.01); *C10M 2207/2815* (2013.01); *C10M 2207/2825* (2013.01); *C10M 2219/046* (2013.01); *C10N 2220/02* (2013.01); *C10N 2230/02* (2013.01); *C10N 2230/04* (2013.01); *C10N 2230/36* (2013.01); *C10N 2230/64* (2013.01); *C10N 2230/74* (2013.01); *C10N 2240/10* (2013.01); *C10N 2260/02* (2013.01)

(58) Field of Classification Search

CPC ..... C10M 2207/104; C10M 2207/105; C10M 2207/107; C10M 105/00; C10M 105/03; C10M 105/08; C10M 103/18; C10M 105/32

See application file for complete search history.

(56) References Cited

U.S. PATENT DOCUMENTS

| | | | | |
|---|---|---|---|---|
| 2,204,620 | A | 6/1940 | Prutton et al. | |
| 3,401,051 | A * | 9/1968 | Bordenca | B01J 2/30 106/403 |
| 5,344,582 | A * | 9/1994 | Umemoto | C10M 105/02 252/73 |
| 6,395,689 | B1 * | 5/2002 | Wagner | C07C 43/18 252/73 |
| 7,031,109 | B1 | 4/2006 | Granstrom et al. | |
| 7,399,323 | B2 | 7/2008 | Renninger et al. | |
| 7,592,295 | B1 * | 9/2009 | Fisher | C07C 13/18 507/110 |
| 7,622,431 | B2 | 11/2009 | Muir | |

(Continued)

FOREIGN PATENT DOCUMENTS

| | | |
|---|---|---|
| CA | 734971 A1 | 5/1966 |
| EP | 0134014 B1 | 7/1989 |

(Continued)

OTHER PUBLICATIONS

EIC Search Nov. 2017.*

International Application No. PCT/EP2014/063760, International Search Report and Written Opinion of the International Searching Authority, dated Sep. 16, 2014.

Benemann et al., "Chemicals from Salt Loving (Halophilic) Microbes," May 1982, Final Report, Directorate for Engineering (ENG), National Science Foundation, Report No. NSF/CPE-82006, Contract No. CPE8114233.

(Continued)

*Primary Examiner* — Pamela H Weiss

(74) *Attorney, Agent, or Firm* — McDonnell Boehnen Hulbert & Berghoff LLP

(57) ABSTRACT

A lubricating composition comprising a base oil of lubricating viscosity and one or more lubricant additives, wherein the base oil comprises or consists of a base stock which comprises or consists of at least one isoprenoid compound comprising: (i) one or two oxygen-containing moieties independently selected from ether and ester moieties; (ii) a first acyclic isoprenoid moiety containing 1 to 5 isoprenyl units; and (iii) optionally, a second acyclic isoprenoid moiety containing 1 to 5 isoprenyl units with the proviso that at least one isoprenoid moiety contains 3 to 5 isoprenyl units where the isoprenoid compound contains a single ether moiety.

22 Claims, No Drawings

(56) References Cited

U.S. PATENT DOCUMENTS

| | | | | |
|---|---|---|---|---|
| 7,691,792 | B1 | 4/2010 | Fisher et al. | |
| 7,846,222 | B2 | 12/2010 | Renninger et al. | |
| 9,012,385 | B2 * | 4/2015 | Di Biase | C08F 220/68 508/463 |
| 9,278,077 | B2 * | 3/2016 | DeBrouse | A61K 47/02 |
| 9,862,906 | B2 * | 1/2018 | Ohler | C10M 105/02 |
| 2003/0022869 | A1 * | 1/2003 | Wiemer | A61K 49/0021 514/143 |
| 2006/0040218 | A1 * | 2/2006 | Wyatt | G03F 7/325 430/431 |
| 2006/0090393 | A1 | 5/2006 | Rowland | |
| 2006/0171613 | A1 | 8/2006 | Shiraishi et al. | |
| 2007/0281873 | A1 | 12/2007 | Okada | |
| 2008/0146469 | A1 * | 6/2008 | Sato | C07C 5/03 508/110 |
| 2009/0117629 | A1 * | 5/2009 | Schmidt-Dannert | C12N 9/1029 435/134 |
| 2011/0282113 | A1 * | 11/2011 | Fisher | C07C 13/18 585/1 |
| 2013/0225462 | A1 * | 8/2013 | Di Biase | C08F 220/68 508/463 |

FOREIGN PATENT DOCUMENTS

| | | | | |
|---|---|---|---|---|
| EP | 1533362 | A1 | 5/2005 | |
| EP | 2357216 | A1 * | 8/2011 | C09K 8/34 |
| WO | 1999/21902 | A1 | 5/1999 | |
| WO | WO 0205856 | A2 * | 1/2002 | A61K 31/216 |
| WO | 2003/099890 | A2 | 12/2003 | |
| WO | 2006/099250 | A1 | 9/2006 | |
| WO | 2012/141784 | A1 | 10/2012 | |
| WO | WO-2012141784 | A1 * | 10/2012 | C07C 5/05 |

OTHER PUBLICATIONS

S.A Pethrick, B.Sc. et al., "Greases for Use over the Temperature Range −65 C. to +100 C.," Selected Government Research Reports vol. II, Lubricants and Lubrication, 1952.

Aziah Serri N et al., "A continuous esterification of malonic acid with citronellol using packed bed reactor: Investigation of parameter and kinetics study," 2010, Food and Bioproducts Processing~Institution of Chemical Engineers, Rugby, GB, 88: No. 2-3.

U.S. Federal Register vol. 78, No. 112 Tuesday Jun. 11 p. 34867 7 CFR Part 3201 final rule for example 3201.102.

* cited by examiner

LUBRICATING COMPOSITIONS CONTAINING ISOPRENE BASED COMPONENTS

CROSS-REFERENCE TO RELATED APPLICATIONS

This application claims priority to International Patent Application No. PCT/EP2014/063760, filed Jun. 27, 2014, which claims priority to EP 13174256.1, filed Jun. 28, 2013, all of which are hereby incorporated herein by reference in their entireties.

FIELD

The present invention relates in general to lubricating compositions. In particular, the present invention provides lubricating compositions, base oils and base stocks and methods of preparing and using the lubricating compositions.

BACKGROUND

Lubricating compositions generally comprise a base oil of lubricating viscosity together with one or more additives to deliver properties including for example, reduced friction and wear, improved viscosity index, detergency, and resistance to oxidation and corrosion. A lubricant base oil may comprise one or more sources of lubricating oil, referred to as base stocks.

Lubricant base stocks used in automotive engine lubricants are generally obtained from petrochemical sources, for example as the higher boiling fractions isolated during the refining of crude oil or as the products of chemical reactions of feedstocks from petrochemical sources. Lubricant base stocks can also be made from Fischer-Tropsch wax.

Lubricant base stocks may be classified as Group I, II, III, IV and V base stocks according to API standard 1509, "ENGINE OIL LICENSING AND CERTIFICATION SYSTEM", September 2012 version 17$^{th}$ edition Appendix E, as set out in Table 1.

TABLE 1

| Group | Saturated hydrocarbon content (% by weight) ASTM D2007 | | Sulphur content (% by weight) ASTM D2622 or D4294 or D4927 or D3120 | | Viscosity Index ASTM D2270 |
|---|---|---|---|---|---|
| I | <90 | and/or | >0.03 | and | ≥80 and <120 |
| II | ≥90 | and | ≤0.03 | and | ≥80 and <120 |
| III | ≥90 | and | ≤0.03 | and | ≥120 |
| IV | polyalphaolefins | | | | |
| V | all base stocks not in Groups I, II, III or IV | | | | |

Group I, Group II and Group III base stocks are generally derived from mineral oils. Group I base stocks are typically manufactured by known processes comprising solvent extraction and solvent dewaxing, or solvent extraction and catalytic dewaxing. Group II and Group III base stocks are typically manufactured by known processes comprising catalytic hydrogenation and/or catalytic hydrocracking, and catalytic hydroisomerisation. Group IV base stocks include for example, hydrogenated oligomers of alpha olefins. Suitable processes for the preparation of the oligomers include for example, free radical processes, Zeigler catalysed processes and cationic Friedel-Crafts catalysed processes. Suitably, polyalphaolefin base stocks are derived for example from $C_8$, $C_{10}$, $C_{12}$, $C_{14}$ olefins and mixtures of one or more thereof.

In recent years, there has been an increased focus on identifying sustainable replacements for products that have historically been obtained from fossil sources. Bio-derived materials (sometimes also called biobased materials) can play an important role in future lubricant formulations, both in meeting customer demand for "green" products and in reducing dependence on non-renewable resources for example crude oil.

Lubricant base stocks have been obtained from vegetable sources, generally as triglyceride esters of fatty acids, such as palm oil, sunflower oil and rapeseed oil. Free fatty acids from vegetable and animal sources may also be used in the preparation of various synthetic ester base stocks.

US2007/0281873 relates to a lubricating oil composition for fluid dynamic bearings which comprises 50 to 100% by mass of an ether compound comprising at least one ether bond and having 11 to 34 carbon atoms as a base oil and has a kinematic viscosity of at least 2.2 $mm^2/s$ at 100° C.

The use of six percent of lithium stearate in dihydrocitronellyl ether to form a grease is described by Pethrick S A and Wood H S in "*Greases for Use over the Temperature Range* −65° C. to +100° C." Selected Government Research Reports (Great Britain Ministry of Supply), Lubricants and Lubrication (1952), Volume 11 Report. No. 2, 11-20. On page 16 of the Report it is stated:

"In research work on synthetic hydraulic oils, workers in the Faraday Laboratory of the Royal Institution discovered that dihydrocitronellyl ether has a low freezing point combined with low viscosity. A pint sample of this material was made by a manufacturer and a few preliminary experiments were made on the utility of this ether for grease making. Six percent of lithium stearate in the ether formed a grease which when applied to a bearing allowed the latter to be rotated with ease at −70° C. Some bleeding occurred with this grease on storage for two months, but it is anticipated that this could be obviated by compounding with aluminium stearate in addition to the lithium stearate. The volatility of this ether is approximately the same as that of oil to specification D.T.D.44D when tested by I.P. method 46/42, so that no trouble due to evaporation would be expected from a grease made from this material."

A dihydrocitronellyl moiety contains two isoprenyl units.

Benemann, J. R. et. Al. in "*Chemicals From Salt Loving* (*Halophilic*) *Microbes*" Final Report, National Science Foundation NSF/CPE-82006 May 1982 states in its abstract: "The possibility of producing specialty chemicals—specifically diphytanyl glycerol ether (DPGE), a potential lubricating agent, was examined . . . ". In the conclusion it is stated: "The results obtained during this investigation do not support the premise that lipids from Halobacteria can be economically produced. The yields obtained were very low under all conditions tested; recoveries for DPGE were even lower than those reported in the literature . . . . Glycerol ethers, if useful as specialty lubricants would be more easily synthesized chemically."

There remains a need in the art to identify new renewable sources of lubricant base stocks. In particular, there remains a need in the art for high performance lubricating oil compositions which contain base stock which may be bio-derived (also called biobased), at least in part.

BRIEF SUMMARY

The present invention is based at least in part on the identification of isoprenoid compounds as a source (for example, a biological source) of compounds which are suitable for use as components of lubricating compositions, and particularly as a source of base stocks for lubricating oil compositions and components thereof. Isoprenoids are members of a large class of organic compounds that are produced by a wide variety of organisms. Isoprenoids comprise isoprenyl units which are based upon isoprene. Isoprene has the formula:

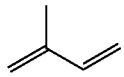

Isoprenyl units may be arranged head-to-tail to form chains, or may be arranged to form various ring structures.

Accordingly, in a first aspect, the present invention provides a lubricating composition comprising a base oil of lubricating viscosity and one or more lubricant additives, wherein the base oil comprises or consists of a base stock which comprises or consists of at least one isoprenoid compound comprising:

(i) one or two oxygen-containing moieties independently selected from ether and ester moieties;

(ii) a first acyclic isoprenoid moiety containing 1 to 5 isoprenyl units; and (iii) optionally, a second acyclic isoprenoid moiety containing 1 to 5 isoprenyl units with the proviso that at least one isoprenoid moiety contains 3 to 5 isoprenyl units where the isoprenoid compound contains a single ether moiety.

These and other examples of the disclosure have an advantage that base stocks for the lubricating compositions of the invention may be synthesised, at least in part, from bio-derived feedstocks (also called biobased feedstocks) for example via synthetic methods that are amenable to scale up. The base stocks have also been found to exhibit a range of desirable lubricant properties, for example, when formulated into lubricating compositions, including viscometric properties and/or oxidative stability. Accordingly, the present invention provides at least an attractive alternative to lubricant base stocks that have previously been reported in the art.

DETAILED DESCRIPTION

For the purposes of the present invention, the following terms as used herein shall, unless otherwise indicated, be understood to have the following meanings:

The term "hydrocarbyl" as used herein refers to a group consisting exclusively of hydrogen and carbon atoms, the group containing from 1 to 30 carbon atoms. Examples of hydrocarbyl groups include hydrocarbyl groups containing from 1 to 20 carbon atoms, e.g. from 1 to 12 carbon atoms, e.g. from 1 to 10 carbon atoms. Examples of hydrocarbyl groups include acyclic groups, cyclic groups and groups comprising both an acyclic portion and a cyclic portion. Examples of hydrocarbyl groups include linear groups and branched groups. The term "hydrocarbyl" includes monovalent groups and polyvalent groups as specified. Examples of monovalent hydrocarbyl groups include alkyl, alkenyl, alkynyl, carbocyclyl (e.g. cycloalkyl, cycloalkenyl or aryl) and aralkyl.

The term "alkyl" as used herein refers to a monovalent straight or branched chain alkyl moiety containing from 1 to 30 carbon atoms. Examples of alkyl groups include alkyl groups containing from 1 to 20 carbon atoms, e.g. from 1 to 12 carbon atoms, e.g. from 1 to 10 carbon atoms. Particular examples include alkyl groups containing 1, 2, 3, 4, 5 or 6 carbon atoms. Examples of alkyl groups include methyl, ethyl, n-propyl, isopropyl, n-butyl, sec-butyl, tert-butyl, pentyl, hexyl and the like.

The term "cycloalkyl" as used herein refers to a monovalent saturated aliphatic hydrocarbyl moiety containing from 3 to 20 carbon atoms and containing at least one ring, wherein said ring has at least 3 ring carbon atoms. Examples of cycloalkyl groups include cycloalkyl groups containing from 3 to 16 carbon atoms, e.g. from 3 to 10 carbon atoms. Particular examples include cycloalkyl groups containing 3, 4, 5 or 6 ring carbon atoms. Examples of cycloalkyl groups include groups that are monocyclic, polycyclic (e.g. bicyclic) or bridged ring system. Examples of cycloalkyl groups include cyclopropyl, cyclobutyl, cyclopentyl, cyclohexyl and the like. The term "cycloalkylene" as used herein refers to a corresponding divalent moiety.

The term "alkenyl" as used herein refers to a monovalent straight or branched chain alkyl group containing from 2 to 30 carbon atoms and containing, in addition, at least one carbon-carbon double bond, of either E or Z configuration unless specified. Examples of alkenyl groups include alkenyl groups containing from 2 to 20 carbon atoms, e.g. from 2 to 12 carbon atoms, e.g. from 2 to 10 carbon atoms. Particular examples include alkenyl groups containing 2, 3, 4, 5 or 6 carbon atoms. Examples of alkenyl groups include ethenyl, 2-propenyl, 1-butenyl, 2-butenyl, 3-butenyl, 1-pentenyl, 2-pentenyl, 3-pentenyl, 1-hexenyl, 2-hexenyl, 3-hexenyl and the like.

The term "aryl" as used herein refers to an aromatic carbocyclic ring system containing from 6 to 14 ring carbon atoms. Examples of aryl groups include aryl groups containing from 6 to 10 ring carbon atoms, e.g. 6 ring carbon atoms. An example of an aryl group includes a group that is a monocyclic aromatic ring system or a polycyclic ring system containing two or more rings, at least one of which is aromatic. Examples of aryl groups include aryl groups that comprise from 1 to 6 exocyclic carbon atoms in addition to ring carbon atoms. Examples of aryl groups include aryl groups that are monovalent or polyvalent as appropriate. Examples of monovalent aryl groups include phenyl, benzyl naphthyl, fluorenyl, azulenyl, indenyl, anthryl and the like. An example of a divalent aryl group is 1,4-phenylene.

The term "alkylene" refers to a divalent straight or branched chain saturated hydrocarbyl group containing from 1 to 30 carbon atoms. Examples of alkylene groups include alkylene groups that contain from 1 to 20 carbon atoms, e.g. from 1 to 12 carbon atoms, e.g. from 1 to 10 carbon atoms. Particular examples include alkylene groups that contain 1, 2, 3, 4, 5 or 6 carbon atoms.

The term "alkenylene" refers to a divalent straight or branched chain saturated hydrocarbyl group containing from 2 to 30 carbon atoms and containing, in addition, at least one carbon-carbon double bond, of either E or Z configuration unless specified. Examples of alkenylene groups include alkenylene groups that contain from 2 to 20 carbon atoms, e.g. from 2 to 12 carbon atoms, e.g. from 2 to 10 carbon atoms. Particular examples include alkenylene groups that contain 2, 3, 4, 5 or 6 carbon atoms.

The term "alkoxy" as used herein refers to —O-alkyl, wherein alkyl is as defined herein. In some examples an alkoxy group contains from 1 to 30 carbon atoms, e.g. from 1 to 26 carbon atoms, or from 1 to 20 carbon atoms, or from 1 to 12 carbon atoms e.g. from 1 to 10 carbon atoms. Particular examples include alkoxy groups that contain 1, 2, 3, 4, 5 or 6 carbon atoms. Examples of alkoxy groups include methoxy, ethoxy, propoxy, isopropoxy, butoxy, tert-butoxy, pentoxy, hexoxy and the like.

The term "acyloxy" as used herein refers to —OC(O)-alkyl or —OC(O)-aryl, wherein alkyl and aryl are as defined herein. Examples of acyloxy groups include acyloxy groups that contain from 2 to 20 carbon atoms, e.g. from 2 to 12 carbon atoms, e.g. from 2 to 10 carbon atoms. Particular examples include alkoxy groups that contain 2, 3, 4, 5, 6 or 7 carbon atoms. Examples of acyloxy groups include acetoxy, propoxy, isopropoxy, benzoyloxy and the like.

The term "heterocyclyl" as used herein refers to a saturated (e.g. heterocycloalkyl) or unsaturated (e.g. heteroaryl) heterocyclic ring moiety containing from 3 to 14 ring atoms, wherein said ring atoms include at least one ring carbon atom and at least one ring heteroatom selected from nitrogen, oxygen and sulphur. Examples of heterocyclyl groups include heterocyclyl groups that contain from 3 to 10 ring atoms, e.g. from 3 to 6 ring atoms. Particular examples include heterocyclyl groups that contain 5 or 6 ring atoms, including for example, groups that are saturated, unsaturated or aromatic. Examples of heterocyclyl groups include heterocyclyl groups that, in addition to ring carbon atoms, comprise from 1 to 6 exocyclic carbon atoms. Examples of heterocyclyl groups include those that are monovalent or polyvalent as appropriate.

The term "heteroaryl" as used herein refers to an aromatic heterocyclic ring system containing from 5 to 14 ring atoms, wherein said ring atoms include at least one ring carbon atoms and at least one ring heteroatom selected from nitrogen, oxygen and sulphur. Examples of heteroaryl groups include heteroaryl groups that are a monocyclic ring system or a polycyclic (e.g. bicyclic) ring system, containing two or more rings, at least one of which is aromatic. Examples of heteroaryl groups include those that, in addition to ring carbon atoms, comprise from 1 to 6 exocyclic carbon atoms. Examples of heteroaryl groups include those that are monovalent or polyvalent as appropriate. Examples of heteroaryl groups include furanyl, and benzo[b]furanyl groups.

The term "optionally substituted" as used herein means unsubstituted or substituted. The term "substituted" as used herein as used in connection with a chemical group means that one or more (e.g. 1, 2, 3, 4 or 5) of the hydrogen atoms in that group are replaced independently of each other by a corresponding number of substituents. When present, the one or more substituents are present only at positions where they are chemically possible, i.e. that any substitution is in accordance with permitted valence of the substituted atom and the substituent and that the substitution results in a stable compound. Suitable substituents include hydrocarbyl groups, including for example: methyl; ethyl; n-propyl; iso-propyl; n-butyl; iso-butyl; t-butyl; n-pentyl; neo-pentyl; 3,3-dimethylpropyl; 2,3-dimethylpropyl; 2,2-dirmthylpropyl and 2-ethylhexyl. Suitable substituents include groups comprising heteroatoms including for example: nitrogen, oxygen and sulphur.

The term "isoprenoid" as used herein refers to a monovalent or divalent acyclic hydrocarbyl moiety that is an oligomer of isoprene. Compounds containing isoprenoid moieties are referred to herein as "isoprenoid compounds". The isoprenyl units, for example —[$CH_2CH{=}C(CH_3)CH_2$]— and —[$CH_2CH_2CH(CH_3)CH_2$]— may be connected head to tail and/or head to head in regular or random order.

Unless specified otherwise, the isoprenoid moiety contains from 1 to 5 isoprenyl units, e.g. 2 to 5 isoprenyl units, e.g. 3 to 5 isoprenyl units, e.g. 3 or 4 isoprenyl units, e.g. 3 isoprenyl units.

In at least some examples, the isoprenoid moieties are derived from farnesene or farnesol or combinations thereof. In at least some examples, the isoprenoid compounds are derived from farnesene or farnesol or combinations thereof.

In at least some examples the isoprenoid moiety is derived from bio-derived feedstocks (also called biobased feedstocks), including for example farnesene and farnesol. In at least some examples the isoprenoid compound is derived from bio-derived feedstocks (also called biobased feedstocks), including for example farnesene and farnesol.

Suitably, the isoprenoid moiety is derived from farnesene. Suitably, the isoprenoid compound is derived from farnesene. Farnesene is an isoprenoid compound containing three isoprenyl units. There are six isomers of farnesene. α-Farnesene and β-farnesene differ by the location of one double bond. α-Farnesene is 3,7,11-trimethyl-1,3,6,10-dodecatetraene and β-farnesene is 7,11-dimethyl-3-methylene-1,6,10-dodecatriene. There are four stereoisomers of α-Farnesene and two stereoisomers of β-farnesene.

Other suitable sources of isoprenoid moieties and isoprenoid compounds include compounds containing two isoprenyl units. Examples of compounds containing two isoprenyl units include geraniol, nerol and citronellol.

Geraniol is found in rose oil, palmarosa oil and Java type citronella oil. It also occurs in small quantities in geranium, lemon, and many other essential oils. It may be represented by the formula:

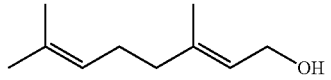

Nerol is found in many essential oils including oils from lemongrass and hops. It is also present in neroli oil and may be represented by the formula:

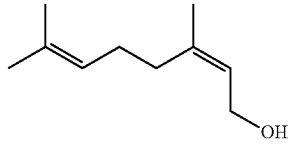

Citronellol has two enantiomers which may be represented by the structural formulae:

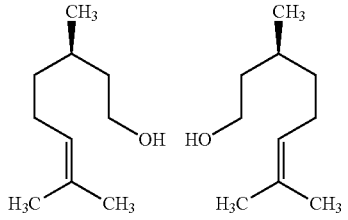

The (+) isomer is found in citronella oil and the (−) isomer is present in oils of rose and Pelargonium geraniums.

In at least some examples (for example where the isoprenoid moiety is bonded to a heteroatom e.g. oxygen, sulphur or nitrogen, through a terminal carbon atom) the isoprenoid moiety is derived from farnesol. In at least some examples (for example where the isoprenoid moiety is bonded to a heteroatom e.g. oxygen, sulphur or nitrogen, through a terminal carbon atom) the isoprenoid compound is derived from farnesol. Farnesol is a natural organic compound which is an acyclic sesquiterpene alcohol. Farnesol is an isoprenoid compound containing three isoprenyl units. Farnesol is present in many essential oils such as citronella, neroli, cyclamen, lemon grass, tuberose, rose, musk, balsam and tolu.

Suitable isoprenoid moieties include saturated and unsaturated isoprenoid moieties. In at least some examples the isoprenoid moieties are saturated isoprenoid moieties. In at least some examples the isoprenoid moieties are unsaturated isoprenoid moieties.

In at least some examples, the isoprenoid compound comprises:

(i) one or two oxygen-containing moieties independently selected from ether and ester moieties;

(ii) a first acyclic isoprenoid moiety containing 3 to 5 isoprenyl units; and (iii) optionally, a second acyclic isoprenoid moiety containing 1 to 5 isoprenyl units.

In at least some examples, the isoprenoid compound is represented by the formula (1), (2) or (3):

$$R^1—O-T^1 \quad (1)$$

$$R^2—C(O)O-T^2 \quad (2)$$

$$T^3-O-T^4 \quad (3)$$

wherein:

$R^1$ and $R^2$ each represent an acyclic unsubstituted hydrocarbyl group or an acyclic substituted hydrocarbyl group other than an acyclic, saturated or unsaturated, isoprenoid moiety containing from 1 to 5 isoprenyl units;

$T^1$ represents an acyclic, saturated or unsaturated, isoprenoid moiety containing from 3 to 5 isoprenyl units;

$T^2$ represents an acyclic, saturated or unsaturated, isoprenoid moiety containing from 1 to 5 isoprenyl units; and $T^3$ and $T^4$ each represent an acyclic, saturated or unsaturated, isoprenoid moiety containing from 1 to 5 isoprenyl units, with the proviso that at least one of $T^3$ and $T^4$ represents an acyclic, saturated or unsaturated, isoprenoid moiety containing from 3 to 5 isoprenyl units.

In at least some examples $T^1$, $T^2$, $T^3$ each independently represents an acyclic, saturated or unsaturated, isoprenoid moiety containing 3, 4 or 5 isoprenyl units, for example an acyclic, saturated or unsaturated, isoprenoid moiety containing 3 isoprenyl units. In at least some examples, each of $T^1$, $T^2$ and $T^3$ is derived from farnesene or farnesol or combinations thereof.

In at least some further examples, the isoprenoid compound is represented by the formula (4), (5), (6), (7) or (8):

$$R^3—O—R^4—O-T^5 \quad (4)$$

$$T^6-O—R^5—O-T^7 \quad (5)$$

$$R^6—O-T^8-O—R^7 \quad (6)$$

$$R^8—OC(O)—R^9—C(O)O-T^9 \quad (7)$$

$$T^{10}-OC(O)—R^{10}—C(O)O-T^{11} \quad (8)$$

wherein:

$R^3$, $R^6$, $R^7$ and $R^8$ each independently represent an acyclic unsubstituted hydrocarbyl group or an acyclic substituted hydrocarbyl group other than an acyclic, saturated or unsaturated, isoprenoid moiety containing from 1 to 5 isoprenyl units;

$R^4$ and $R^5$ each independently represent:

a divalent, cyclic or acyclic hydrocarbyl group, other than a divalent acyclic, saturated or unsaturated, isoprenoid moiety containing from 1 to 5 isoprenyl units;

or a heterocyclyl group;

$R^9$ and $R^{10}$ each independently represent:

a divalent, cyclic or acyclic hydrocarbyl group, other than a divalent acyclic, saturated or unsaturated, isoprenoid moiety containing from 1 to 5 isoprenyl units;

a heterocyclyl group; or a covalent bond;

$T^8$ represents a divalent acyclic, saturated or unsaturated, isoprenoid moiety containing from 1 to 5 isoprenyl units; and $T^5$, $T^6$, $T^7$, $T^9$, $T^{10}$ and $T^{11}$ each independently represents an acyclic, saturated or unsaturated, isoprenoid moiety containing from 1 to 5 isoprenyl units.

In at least some examples $T^5$, $T^6$, $T^7$, $T^9$, $T^{10}$, and $T^{11}$ each independently represents an acyclic, saturated or unsaturated, isoprenoid moiety containing 3, 4 or 5 isoprenyl units, for example an acyclic, saturated or unsaturated, isoprenoid moiety containing 3 isoprenyl units. In at least some examples, each of $T^5$, $T^6$, $T^7$, $T^9$, $T^{10}$, and $T^{11}$ is derived from farnesene or farnesol or combinations thereof.

In at least some examples $T^8$ represents a divalent acyclic, saturated or unsaturated, isoprenoid moiety containing 3, 4 or 5 isoprenyl units, for example a divalent acyclic, saturated or unsaturated, isoprenoid moiety containing 3 isoprenyl units. In at least some examples, $T^8$ is derived from farnesene or farnesol or combinations thereof.

Examples of isoprenyl units include substituted isoprenyl units and unsubstituted isoprenyl units. Examples of substituted isoprenyl units include those substituted with one or two groups represented by the formula —O—$R^{10}$ or the formula —OC(O)—$R^{11}$, wherein $R^{10}$ and $R^{11}$ each represents a hydrocarbyl group containing from 1 to 30 carbon atoms, e.g. from 1 to 26 carbon atoms or from 1 to 20 carbon atoms or from 1 to 10 carbon atoms, for example, wherein $R^{10}$ and $R^{11}$ each represents an acyclic alkyl or alkenyl group containing from 1 to 30 carbon atoms, for example from 1 to 26 carbon atoms or from 1 to 20 carbon atoms or from 1 to 10 carbon atoms.

Suitably, each isoprenyl unit is unsubstituted.

Examples of acyclic isoprenoid moieties (for example, each of $T^1$, $T^2$, $T^3$, $T^4$, $T^5$, $T^6$, $T^7$, $T^9$, $T^{10}$, and $T^{11}$, include:

$$[CH_2CH{=}C(CH_3)CH_2]_mH$$

$$[CH_2CH_2CH(CH_3)CH_2]_nH$$

wherein m and n are each an integer of from 1 to 5, for example 3, 4 or 5, suitably 3 and $$—C(CH_3)(CH{=}CH_2)CH_2—[CH_2CH{=}C(CH_3)CH_2]_pH$$

$$C(CH_3)(CH_2CH_3)CH_2—[CH_2CH_2CH(CH_3)CH_2]_qH$$

wherein p and q are each an integer of from 0 to 4, for example 1, 2 or 3, suitably 2.

Examples of branched acyclic isoprenoid moieties (for example, each of $T^1$, $T^2$, $T^3$, $T^4$, $T^5$, $T^6$, $T^7$, $T^9$, $T^{10}$, and $T^{11}$) include:

$$H[CH_2C(CH_3)=CHCH_2]_rCH_2\overset{|}{C}(CH_3)CH_2CH_2[CH_2C(CH_3)=CHCH_2]_sCH=C(CH_3)CH=CH_2$$

wherein r and s are each an integer such that r+s=0, 1, 2 or 3, for example 2 or 3 and $$H[CH_2CH(CH_3)CH_2CH_2]_tCH_2\overset{|}{C}(CH_3)CH_2CH_2[CH_2CH(CH_3)CH_2CH_2]_uCH_2CH(CH_3)CH_2CH_3$$

wherein t and u are each an integer such that t+u=0, 1, 2 or 3, for example 2 or 3.

In at least some examples, the isoprenoid moiety is bonded to an adjacent oxygen atom via a terminal carbon atom of the isoprenoid moiety, for example as represented by the structures:

$$—O—[CH_2CH=C(CH_3)CH_2]_{m'}H$$

$$—O—[CH_2CH_2CH(CH_3)CH_2]_{n'}H$$

wherein m' and n' are each an integer of from 1 to 5, for example 3, 4 or 5, suitably 3 and $$—O—C(CH_3)(CH=CH_2)CH_2—[CH_2CH=C(CH_3)CH_2]_{p'}H$$

$$—O—C(CH_3)(CH_2CH_3)CH_2—[CH_2CH_2CH(CH_3)CH_2]_{q'}H$$

wherein p' and q' are each an integer of from 0 to 4, for example 1, 2 or 3, suitably 2.

In at least some examples, the isoprenoid moiety is bonded to an adjacent oxygen atom via a non-terminal carbon atom of the isoprenoid moiety, for example as represented by the structures:

$$H[CH_2C(CH_3)=CHCH_2]_{r'}CH_2\overset{|}{C}(CH_3)CH_2CH_2[CH_2C(CH_3)=CHCH_2]_{s'}CH=C(CH_3)CH=CH_2$$

wherein r' and s' are each an integer such that r'+s'=0, 1, 2 or 3, for example 2 or 3 and $$H[CH_2CH(CH_3)CH_2CH_2]_{t'}CH_2\overset{|}{C}(CH_3)CH_2CH_2[CH_2CH(CH_3)CH_2CH_2]_{u'}CH_2CH(CH_3)CH_2CH_3$$

wherein t' and u' are each an integer such that t+u=0, 1, 2 or 3, for example 2 or 3.

In at least some examples the isoprenoid moiety is bonded to an adjacent oxygen atom via a primary carbon atom of the isoprenoid moiety, for example as represented by the structures:

$$—O—[CH_2CH=C(CH_3)CH_2]_{m'}H$$

$$—O—[CH_2CH_2CH(CH_3)CH_2]_{n'}H$$

wherein m' and n' are each an integer of from 1 to 5, for example 3, 4 or 5, suitably 3.

In at least some examples the isoprenoid moiety is bonded to an adjacent oxygen atom via a secondary carbon atom of the isoprenoid moiety, for example as represented by the structures:

$$—O—C(CH_3)(CH=CH_2)CH_2—[CH_2CH=C(CH_3)CH_2]_{p'}H$$

$$—O—C(CH_3)(CH_2CH_3)CH_2—[CH_2CH_2CH(CH_3)CH_2]_{q'}H$$

wherein p' and q' are each an integer of from 0 to 4, for example 1, 2 or 3, suitably 2.

In at least some examples, the isoprenoid moiety is bonded to an adjacent oxygen atom via a tertiary carbon atom of the isoprenoid moiety, for example as represented by the structures:

$$H[CH_2C(CH_3){=}CHCH_2]_{r'}CH_2\overset{\overset{\displaystyle O}{|}}{C}(CH_3)CH_2CH_2[CH_2C(CH_3){=}CHCH_2]_{s'}CH{=}C(CH_3)CH{=}CH_2$$

wherein r' and s' are each an integer such that r'+s'=0, 1, 2 or 3, for example 2 or 3 and $$H[CH_2CH(CH_3)CH_2CH_2]_{t'}CH_2\overset{\overset{\displaystyle O}{|}}{C}(CH_3)CH_2CH_2[CH_2CH(CH_3)CH_2CH_2]_{u'}CH_2CH(CH_3)CH_2CH_3$$

wherein t' and u' are each an integer such that t+u=0, 1, 2 or 3, for example 2 or 3.

Examples of divalent acyclic isoprenyl moieties (for example $T^8$) include divalent acyclic, saturated or unsaturated, isoprenoid moiety containing 1 to 5 isoprenyl units, for example 3 or 4 isoprenyl units, for example 3 isoprenyl units. Suitably, the divalent acyclic isoprenyl unit is derived from farnesene or farnesol or combinations thereof. Examples of divalent acyclic isoprenyl moieties include:

$$—[CH_2CH_2CH(CH_3)CH_2]_v— \text{ and } —[CH_2CH{=}C(CH_3)CH_2]_w—$$

wherein each of v and w is an integer of from 1 to 5, for example from 3 to 5, for example 3 or 4, and suitably 3. Suitably, each divalent acyclic isoprenyl moiety (for example $T^8$) is derived from farnesene or farnesol or combinations thereof.

In at least some examples (for example $T^8$), the divalent isoprenoid moiety is bonded to at least one adjacent oxygen atom via a non-terminal carbon atom of the divalent isoprenoid moiety. Examples of isoprenoid compounds in which divalent isoprenoid moieties are bonded to at least one adjacent oxygen atom via at last one non-terminal carbon atom include those that are unsaturated with the following structural formulae:

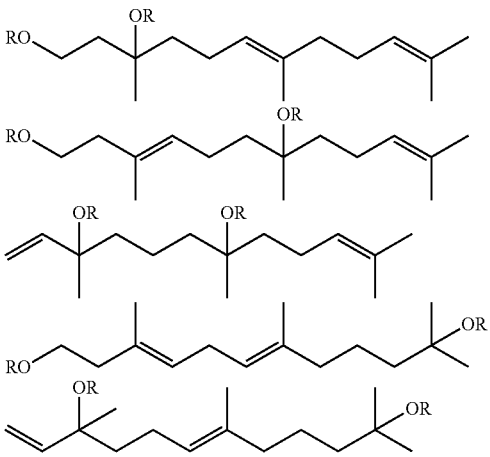

-continued

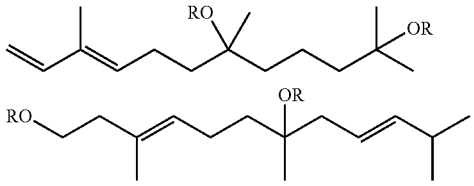

in which the R groups each independently represent an acyclic unsubstituted hydrocarbyl group or an acyclic substituted hydrocarbyl group other than an acyclic, saturated or unsaturated, isoprenoid moiety containing from 1 to 5 isoprenyl units.

Examples of isoprenoid compounds in which divalent isoprenoid moieties are bonded to at least one adjacent oxygen atom via at last one non-terminal carbon atom include those that are saturated with the following structural formulae:

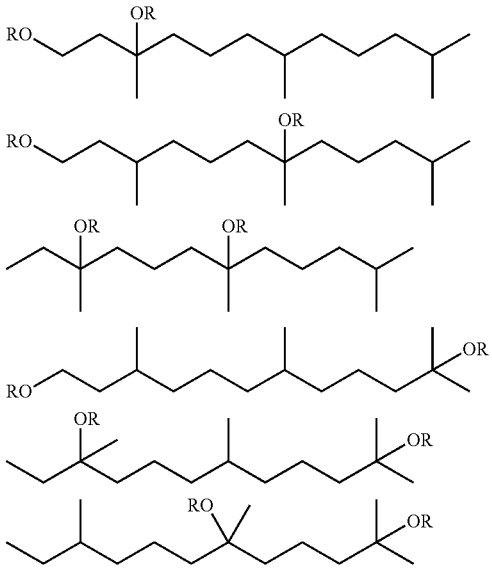

-continued

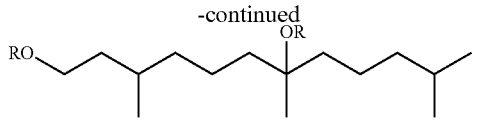

in which the R groups each independently represent an acyclic unsubstituted hydrocarbyl group or an acyclic substituted hydrocarbyl group other than an acyclic, saturated or unsaturated, isoprenoid moiety containing from 1 to 5 isoprenyl units.

In at least some examples, $R^1$, $R^3$, $R^6$, $R^7$ and $R^8$ each independently represents a $C_1$ to $C_{30}$ hydrocarbyl group (other than an acyclic, saturated or unsaturated, isoprenoid moiety containing 1 to 5 isoprenyl units), for example a $C_8$ to $C_{30}$ alkyl or alkenyl group other than an acyclic, saturated or unsaturated, isoprenoid moiety containing 1 to 5 isoprenyl units, for example a $C_8$ to $C_{20}$ alkyl or alkenyl group, or a $C_{12}$ to $C_{20}$ alkyl or alkenyl group, or a $C_{12}$ to $C_{18}$ alkyl or alkenyl group, or a $C_8$ to $C_{18}$ alkyl or alkenyl group, or a $C_8$ to $C_{16}$ alkyl or alkenyl group, or a $C_8$ to $C_{14}$ alkyl or alkenyl group other than an acyclic, saturated or unsaturated, isoprenoid moiety containing 1 to 5 isoprenyl units. In at least some examples, $R^1$, $R^3$, $R^6$, $R^7$ and $R^8$ are each independently selected from n-decyl, n-dodecyl, n-tetradecyl, n-hexadecyl, cis-9-hexadecen-1-yl, n-octadecyl, 16-methylheptadecyl, cis-9-octadecen-1-yl, and 9Z,12Z-octadecadien-1-yl. Suitably, $R^1$, $R^3$, $R^6$, $R^7$ and $R^8$ are each independently selected from decyl and tetradecyl.

In at least some examples, $R^1$, $R^3$, $R^6$, $R^7$ and $R^8$ are each independently derived from the corresponding fatty alcohols, for example capric alcohol, lauryl alcohol, myristyl alcohol, cetyl alcohol, palmitoleyl alcohol, stearyl alcohol, isostearyl alcohol, oleyl alcohol or linoleyl alcohol.

In at least some examples, $R^2$ represents a $C_1$ to $C_{30}$ hydrocarbyl group (other than an acyclic, saturated or unsaturated, isoprenoid moiety containing 1 to 5 isoprenyl units), for example a $C_7$ to $C_{29}$ alkyl or alkenyl group, or a $C_7$ to $C_{19}$ alkyl or alkenyl group, or a $C_9$ to $C_{19}$ alkyl or alkenyl group, or a $C_{11}$ to $C_{19}$ alkyl or alkenyl group, or a $C_{11}$ to $C_{17}$ alkyl or alkenyl group, or a $C_{13}$ to $C_{17}$ alkyl or alkenyl group, or a $C_{15}$ to $C_{17}$ alkyl or alkenyl group, other than an acyclic, saturated or unsaturated, isoprenoid moiety containing 1 to 5 isoprenyl units. In at least some examples, $R^2$ is selected from n-nonyl, n-undecyl, n-tridecyl, n-pentadecyl, cis-8-pentadecen-1-yl, n-heptadecyl, 15-methylhexadecyl, cis-8-heptadecen-1-yl, and 8Z,11Z-heptadecadien-1-yl.

In at least some examples, the group $R^2$—C(O)O— is derived from the corresponding fatty acid, for example decanoic acid, dodecanoic acid, myristic acid, palmitic acid, palmitoleic acid, stearic acid, isostearic acid, oleic acid or linoleic acid.

In at least some examples, $R^4$ and $R^5$ each represents a divalent, cyclic or acyclic $C_1$ to $C_{30}$ hydrocarbyl group (other than an acyclic, saturated or unsaturated, isoprenoid moiety containing 1 to 5 isoprenyl units), for example a $C_2$ to $C_{10}$ alkylene group, a $C_2$ to $C_{10}$ alkenylene group, a $C_5$ to $C_{10}$ cycloalkylene group, a $C_6$ to $C_{10}$ aryl group, or a $C_4$ to $C_{10}$ heterocyclyl group other than an acyclic, saturated or unsaturated, isoprenoid moiety containing 1 to 5 isoprenyl units. In at least some examples, $R^4$ and $R^5$ each represents a $C_2$ to $C_{10}$ alkylene group, a $C_2$ to $C_{10}$ alkenylene group or a $C_6$ to $C_{10}$ aryl group other than an acyclic, saturated or unsaturated, isoprenoid moiety containing 1 to 5 isoprenyl units. In at least some examples, $R^4$ and $R^5$ each represents a $C_2$ to $C_6$ alkylene group, a $C_2$ to $C_6$ alkenylene group or a $C_6$ aryl group other than an acyclic, saturated or unsaturated, isoprenoid moiety containing 1 to 5 isoprenyl units. Examples of suitable groups include ethane-1,2-diyl, propane-1,2-diyl, propane-1,3-diyl, n-butane-1,2-diyl, n-butane-1,4-diyl, but-2-ene-1,4-diyl, 1,2-phenylene and 1,4-phenylene. Suitable $R^4$ and $R^5$ groups include ethane-1,2-diyl, 1,2-phenylene and 1,4-phenylene.

In at least some examples, the —O—$R^4$—O— group or —O—$R^5$—O— group is derived from the corresponding diol compound. Suitable diol compounds include 1,2-diols, 1,3-diols and 1,4-diols, for example, ethylene-diol, propylene-1,2-diol, propylene-1,3-diol, butylene-1,2-diol, butylene-1,3-diol, butylene-1,4-diol, 2-butene-1,4-diol, benzene-1,2-diol and hydroquinone.

In at least some examples, $R^9$ and $R^{10}$ each represents a divalent, cyclic or acyclic $C_1$ to $C_{30}$ hydrocarbyl group (other than an acyclic, saturated or unsaturated, isoprenoid moiety containing 1 to 5 isoprenyl units), for example a $C_1$ to $C_{10}$ alkylene group, a $C_2$ to $C_{10}$ alkenylene group, a $C_6$ to $C_{10}$ aryl group, a $C_4$ to $C_{10}$ heterocyclyl group, or a covalent bond, other than an acyclic, saturated or unsaturated, isoprenoid moiety containing 1 to 5 isoprenyl units. In at least some examples, $R^9$ and $R^{10}$ each represents a $C_1$ to $C_4$ alkylene group, a $C_2$ to $C_4$ alkenylene group, a $C_6$ aryl group, a $C_4$ to $C_6$ heterocyclyl group, or a covalent bond other than an acyclic, saturated or unsaturated, isoprenoid moiety containing 1 to 5 isoprenyl units. Examples of $R^9$ and $R^{10}$ groups include a covalent bond, methylene, ethane-1,2-diyl, propane-1,3-diyl, n-butane-1,4-diyl, n-pentane-1,5-diyl, 1,2-phenylene, 1,3-phenylene, 1,4-phenylene, ethene-1,2-diyl (i.e. —CH=CH—, E or Z configuration), 2,5-furandiyl and 2,5-tetrahydrofurandiyl. More suitable $R^9$ and $R^{10}$ groups include a covalent bond, methylene, ethane-1,2-diyl, 1,2-phenylene, 1,4-phenylene, 2,5-furandiyl and 2,5-tetrahydrofurandiyl. Still more suitable $R^9$ and $R^{10}$ groups include 2,5-furandiyl, cis 2,5-tetrahydrofurandiyl and trans 2,5-tetrahydrofurandiyl. In at least some examples the isoprenoid compounds are racemic mixtures.

In at least some examples, each of the —OC(O)—$R^9$—C(O)O— group and the —OC(O)—$R^{10}$—C(O)O— group is derived from the corresponding dicarboxylic acid compound, for example, oxalic acid, malonic acid, succinic acid, glutaric acid, adipic acid, pimelic acid, phthalic acid, isophthalic acid, terephthalic acid, maleic acid, fumaric acid, furan-2,5-dicarboxylic acid or tetrahydrofuran-2,5-dicarboxylic acid. In at least some example, the dicarboxylic acids are bioderived, for example succinic acid derived for example from fermentation of sugars.

Exemplary compounds of formula (1) include those wherein $R^1$ represents a $C_8$ to $C_{30}$ alkyl or alkenyl group, for example a $C_8$ to $C_{20}$ alkyl or alkenyl group other than an acyclic, saturated or unsaturated, isoprenoid moiety containing 1 to 5 isoprenyl units and $T^1$ represents an acyclic, saturated or unsaturated, isoprenoid moiety containing from 3 to 5 isoprenyl units, for example 3 or 4 isoprenyl units and suitably 3 isoprenyl units. Suitable compounds of formula (1) include those wherein $R^1$ is a $C_{12}$ to $C_{20}$ alkyl or alkenyl group other than an acyclic, saturated or unsaturated, isoprenoid moiety containing 1 to 5 isoprenyl units and $T^1$ is represented by a formula selected from —$[CH_2CH_2CH(CH_3)CH_2]_rH$ and —$[CH_2CH{=}C(CH_3)CH_2]_rH$ wherein r is an integer of from 3 to 5, for example 3 or 4, and suitably 3 isoprenyl units, for example derived from farnesene or farnesol.

Compounds of formula (1) include those represented by the formulas (9) and (10):

(9)

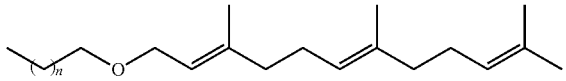

(10)

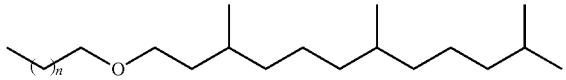

wherein n is 10, 12, 14 or 16, for example wherein n is 10, 12 or 16, e.g. 10 or 12. Another example of a compound represented by formula (1) is represented by formula: (11):

(11)

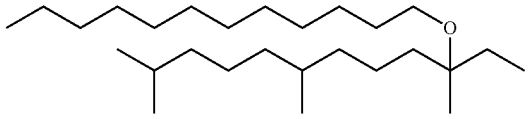

Exemplary compounds of formula (2) include those wherein $R^2$ is a $C_7$ to $C_{19}$ alkyl or alkenyl group other than an acyclic, saturated or unsaturated, isoprenoid moiety containing 1 to 5 isoprenyl units and $T^2$ represents an acyclic, saturated or unsaturated, isoprenoid moiety containing from 3 to 5 isoprenyl units, for example 3 or 4 isoprenyl units and suitably 3 isoprenyl units. Suitable compounds of formula (2) include those wherein $R^2$ is a $C_{11}$ to $C_{19}$ alkyl or alkenyl group other than an acyclic, saturated or unsaturated, isoprenoid moiety containing 1 to 5 isoprenyl units and $T^2$ is represented by a formula selected from —$[CH_2CH_2CH(CH_3)CH_2]_rH$ and —$[CH_2CH{=}C(CH_3)CH_2]_rH$ wherein r is an integer of from 3 to 5, for example 3 or 4, and suitably 3 isoprenyl units, for example derived from farnesene or farnesol.

Compounds of formula (2) include farnesyl oleate (12):

(12)

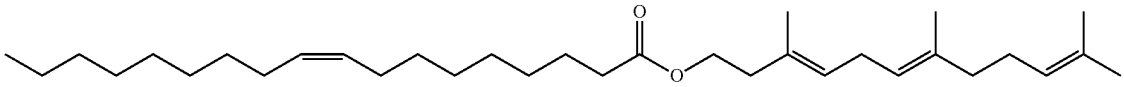

and hydrogenated farnesyl oleate.

Exemplary compounds of formula (3) include those wherein $T^3$ and $T^4$ independently represent an acyclic, saturated or unsaturated, isoprenoid moiety containing 3 to 5 isoprenyl units, for example 3 or 4 isoprenyl units and suitably 3 isoprenyl units. Suitable compounds of formula (3) include those wherein $T^3$ and $T^4$ each represent the same group selected from —$[CH_2CH_2CH(CH_3)CH_2]_pH$ and —$[CH_2CH{=}C(CH_3)CH_2]_pH$ wherein p is an integer of from 3 to 5, for example 3 or 4, and suitably 3 isoprenyl units, for example derived from farnesene or farnesol.

Compounds of formula (3) include difarnesyl ether (13) and hydrogenated difarnesyl ether (14):

(13)

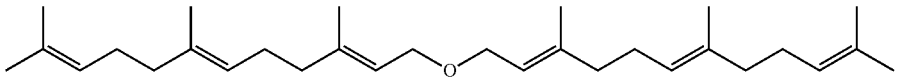

(14)

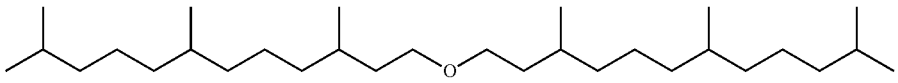

Exemplary compounds of formula (4) include those wherein $R^4$ represents a $C_2$ to $C_{10}$ alkylene group, a $C_2$ to $C_{10}$ alkenylene group, a $C_5$ to $C_{10}$ cycloalkylene group, a $C_6$ to $C_{10}$ aryl group, or a $C_4$ to $C_{10}$ heterocyclyl group, other than an acyclic, saturated or unsaturated, isoprenoid moiety containing 1 to 5 isoprenyl units, for example a $C_2$ to $C_{10}$ alkylene group, a $C_2$ to $C_{10}$ alkenylene group or a $C_6$ to $C_{10}$ aryl group including for example a $C_2$ to $C_6$ alkylene group, a $C_2$ to $C_6$ alkenylene group or a $C_6$ aryl group other than an acyclic, saturated or unsaturated, isoprenoid moiety containing 1 to 5 isoprenyl units. Examples of suitable groups include ethane-1,2-diyl, propane-1,2-diyl, propane-1,3-diyl, n-butane-1,2-diyl, n-butane-1,4-diyl, but-2-ene-1,4-diyl, 1,2-phenylene and 1,4-phenylene. Exemplary compounds of formula (4) include those wherein $T^5$ represents an acyclic, saturated or unsaturated, isoprenoid moiety containing 3 to 5 isoprenyl units, for example 3 or 4 isoprenyl units and suitably 3 isoprenyl units, for example derived from farnesene or farnesol. Exemplary compounds of formula (4) include those represents by the formula:

$$CH_3CH_2CH_2—O—CH_2CH(CH_3)—O\text{-}T^5 \quad (15)$$

Exemplary compounds of formula (5) include those wherein $R^5$ represents a $C_2$ to $C_{10}$ alkylene group, a $C_2$ to $C_{10}$ alkenylene group, a $C_5$ to $C_{10}$ cycloalkylene group, a $C_6$ to $C_{10}$ aryl group, or a $C_4$ to $C_{10}$ heterocyclyl group, other than an acyclic, saturated or unsaturated, isoprenoid moiety containing 1 to 5 isoprenyl units, for example a $C_2$ to $C_{10}$ alkylene group, a $C_2$ to $C_{10}$ alkenylene group or a $C_6$ to $C_{10}$ aryl group including for example a $C_2$ to $C_6$ alkylene group, a $C_2$ to $C_6$ alkenylene group or a $C_6$ aryl group other than an acyclic, saturated or unsaturated, isoprenoid moiety containing 1 to 5 isoprenyl units. Examples of suitable groups include ethane-1,2-diyl, propane-1,2-diyl, propane-1,3-diyl, n-butane-1,2-diyl, n-butane-1,4-diyl, but-2-ene-1,4-diyl, 1,2-phenylene and 1,4-phenylene. Exemplary compounds of formula (5) include those wherein $T^5$ and $T^6$ each independently represents an acyclic, saturated or unsaturated, isoprenoid moiety containing 3 to 5 isoprenyl units, for example 3 or 4 isoprenyl units and suitably 3 isoprenyl units, for example derived from farnesene or farnesol.

Compounds of formula (5) include 1,4-bis((3,7,11-trimethyldodecyl)oxy)benzene. This is represented by the formula:

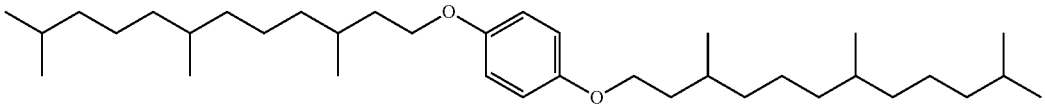

(16)

Other examples of compounds of formula (5) include the compound represented by the formula:

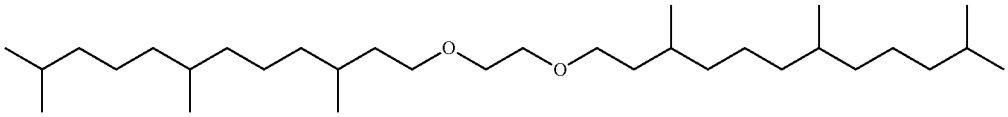

(17)

and its unsaturated analogues.

Other examples of compounds of formula (5) include compounds represented by the formula:

$$T^6\text{-}O—CH_2CH(CH_3)—O\text{-}T^7 \quad (18)$$

Exemplary compounds of formula (6) include those wherein $R^6$ and $R^7$ each independently represents a $C_8$ to $C_{30}$ alkyl or alkenyl group, for example a $C_8$ to $C_{20}$ alkyl or alkenyl group, or a $C_{12}$ to $C_{20}$ alkyl or alkenyl group, or a $C_{12}$ to $C_{18}$ alkyl or alkenyl group, or a $C_8$ to $C_{18}$ alkyl or alkenyl group, or a $C_8$ to $C_{16}$ alkyl or alkenyl group, or a $C_8$ to $C_{14}$ alkyl or alkenyl group other than an acyclic, saturated or unsaturated, isoprenoid moiety containing 1 to 5 isoprenyl units and $T^8$ represents a divalent acyclic, saturated or unsaturated, isoprenoid moiety containing from 3 to 5 isoprenyl units, for example 3 or 4 isoprenyl units and suitably 3 isoprenyl units, for example derived from farnesene or farnesol. Suitable compounds of formula (6) include those wherein $R^6$ and $R^7$ are each independently a $C_8$ to $C_{30}$ alkyl or alkenyl group other than an acyclic, saturated or unsaturated, isoprenoid moiety containing 1 to 5 isoprenyl units and $T^3$ is represented by a formula selected from $—[CH_2CH_2CH(CH_3)CH_2]_v—$ and $—[CH_2CH{=}C(CH_3)CH_2]_w—$ wherein each of v and w is an integer of from 3 to 5, for example 3 or 4, and suitably 3. Suitably, $T^8$ is derived from farnesene or farnesol.

Compounds of formula (6) include:

(19)

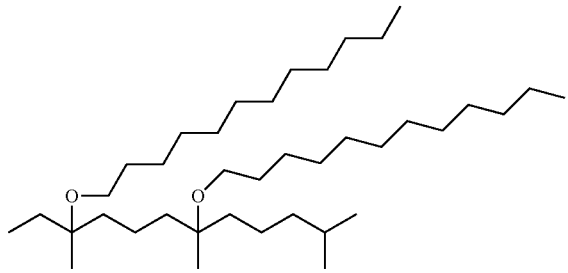

Exemplary compounds of formula (7) include those wherein $R^8$ represents a $C_8$ to $C_{30}$ alkyl or alkenyl group, for example a $C_8$ to $C_{20}$ alkyl or alkenyl group, or a $C_{12}$ to $C_{20}$ alkyl or alkenyl group, or a $C_{12}$ to $C_{18}$ alkyl or alkenyl group, or a $C_8$ to $C_{18}$ alkyl or alkenyl group, or a $C_8$ to $C_{16}$ alkyl or alkenyl group, or a $C_8$ to $C_{14}$ alkyl or alkenyl group other than an acyclic, saturated or unsaturated, isoprenoid moiety containing 1 to 5 isoprenyl units, $R^9$ represents a covalent bond, a $C_1$ to $C_{10}$ alkylene group, a $C_2$ to $C_{10}$ alkenylene group, a $C_6$ to $C_{10}$ aryl group, or a $C_4$ to $C_{10}$ heterocyclyl group, other than an acyclic, saturated or unsaturated, isoprenoid moiety containing 1 to 5 isoprenyl units and $T^9$ represents an acyclic, saturated or unsaturated, isoprenoid moiety containing from 3 to 5 isoprenyl units, suitably 3 or 4 isoprenyl units and for example 3 isoprenyl units, for example derived from farnesene or farnesol. Suitable compounds of formula (5) include those wherein $R^8$ is a $C_{12}$ to $C_{20}$ alkyl or alkenyl group, other than an acyclic, saturated or unsaturated, isoprenoid moiety containing 1 to 5 isoprenyl units, $R^9$ represents a covalent bond, $C_1$ to $C_4$ alkylene group, a $C_2$ to $C_4$ alkenylene group, a $C_6$ aryl group, or a $C_4$ to $C_6$ heterocyclyl group other than an acyclic, saturated or unsaturated, isoprenoid moiety containing 1 to 5 isoprenyl units and $T^9$ has a formula selected from —$[CH_2CH_2CH(CH_3)CH_2]_rH$ and —$[CH_2CH{=}C(CH_3)CH_2]_rH$ wherein r is an integer of from 3 to 5, suitably 3 or 4, and more suitably 3. Suitably, $T^9$ is derived from farnesene or farnesol. Compounds of formula (7) include:

(20)

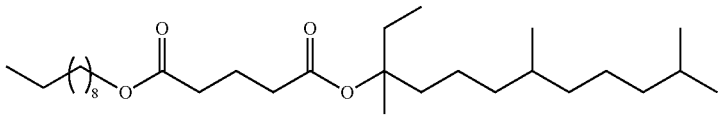

Exemplary compounds of formula (8) include those wherein $R^{10}$ represents a covalent bond, a $C_1$ to $C_{10}$ alkylene group, a $C_2$ to $C_{10}$ alkenylene group, a $C_6$ to $C_{10}$ aryl group, or a $C_4$ to $C_{10}$ heterocyclyl group, other than an acyclic, saturated or unsaturated, isoprenoid moiety containing 1 to 5 isoprenyl units and $T^{10}$ and $T^{11}$ each independently represent an acyclic, saturated or unsaturated, isoprenoid moiety containing 1 to 5 isoprenyl units, for example, 3 to 5 isoprenyl units, for example 3 or 4 isoprenyl units and suitably 3 isoprenyl units, for example derived from farnesene or farnesol. Suitable compounds of formula (8) include those wherein $R^{10}$ represents a covalent bond, a $C_1$ to $C_4$ alkylene group, a $C_2$ to $C_4$ alkenylene group, a $C_6$ aryl group, or a $C_4$ to $C_6$ heterocyclyl group, and $T^{10}$ and $T^{11}$ each represent the same group selected from —$[CH_2CH_2CH(CH_3)CH_2]_nH$ and —$[CH_2CH{=}C(CH_3)CH_2]_mH$ wherein m and n are each an integer of from 1 to 5, for example 3, 4 or 5, suitably 3. Suitably, $T^{10}$ and $T^{11}$ are each derived from farnesene or farnesol.

Compounds of formula (8) include difarnesyl-furan-2,5-dicarboxylate (21), hydrogenated difarnesyl-furan-2,5-dicarboxylate (22) and hydrogenated difarnesyl terephthalate (23):

(21)

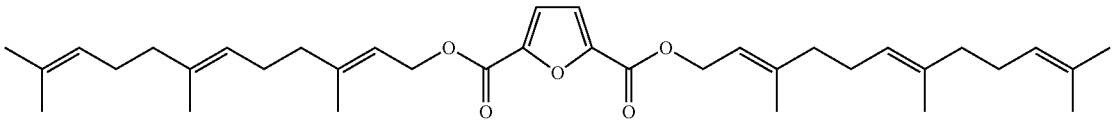

(22)

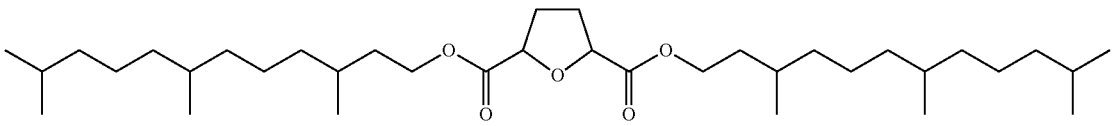

(23)

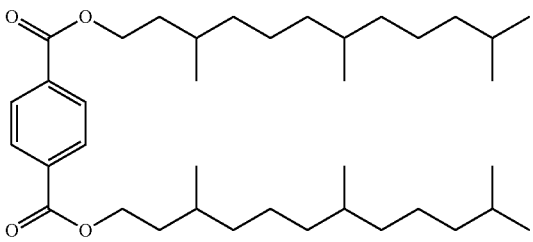

In at least some examples of the present disclosure, the at least one isoprenoid compound has a formula selected from formulae (1), (2), (3), (4), (5), (6), (7), (8) for example the at least one isoprenoid compound has a formula selected from formulae (9), (10), (11), (12), (13), (14), (15), (16), (17), (18), (19), (20), (21), (22) and (23) and as defined herein.

Methods for making the isoprenoid compounds as defined herein include chemical syntheses and biological syntheses and combinations thereof. Methods for making isoprenoid compounds are known in the art, for example methods as described in U.S. Pat. No. 7,399,323. Suitably, the at least one isoprenoid compound as defined herein or precursor therefor is derived from a biological source, for example by treating a suitable feedstock with microorganisms to produce the isoprenoid compound or precursor therefor. Examples of suitable microorganisms include yeasts and bacteria (for example *E. Coli*). Examples of microorganisms include microorganisms adapted for example by bioengineering to produce the isoprenoid compound or precursor thereof. Examples of suitable feedstocks include sugar(s) and glycerol. Examples of suitable sugars include those available from sugar cane. Methods for converting sugars or glycerol or combinations thereof to isoprenoid compounds include contacting the sugar and/or glycerol with microorganisms adapted to produce the isoprenoid compound, for example as described in U.S. Pat. No. 7,399,323. Methods of making the isoprenoid compounds as defined herein include chemical syntheses and biological syntheses and combinations thereof in which suitable starting materials include for example farnesene or farnesol or combinations thereof. Suitable methods include methods in which farnesene, farnesol or combinations thereof have been derived from biological sources, for example by treating a suitable feedstock with microorganisms to produce the farnesene and/or farnesol, for example by treating a suitable feedstock with microorganisms adapted to produce the farnesene and/or farnesol, for example as described in U.S. Pat. No. 7,399,323.

Methods of making the isoprenoid compounds as defined herein include chemical syntheses and biological syntheses and combinations thereof in which suitable starting materials include for example isoprenoid compounds containing two isoprenyl units, for example geraniol, nerol and citronellol and combinations thereof. Suitable methods include methods in which the isoprenoid compound containing two isoprenyl units has been derived from biological sources, for example by treating a suitable feedstock with microorganisms to produce the isoprenoid compound, for example by treating a suitable feedstock with microorganisms adapted to produce the isoprenoid compound.

In at least some examples of the present disclosure, the at least one isoprenoid compound exhibits a Kv40C (kinematic viscosity measured at 40° C.) of 70 cSt or less, for example a Kv40C of 50 cSt or less, or a Kv40C of 40 cSt or less, or a Kv40C of 30 cSt or less, or a Kv40C of 20 cSt or less. In at least some examples of the present disclosure, the at least one isoprenoid compound exhibits a Kv100C (kinematic viscosity measured at 100° C.) of from 2 cSt to 18 cSt, for example Kv100C of from 2 cSt to 14 cSt, or a Kv100C of from 2 cSt to 10 cSt, or a Kv100C of from 2 cSt to 8.5 cSt, or a Kv100C of from 2 cSt to 8 cSt, or a Kv100C of from 2 cSt to 7 cSt, or a Kv100C of from 2 cSt to 6 cSt, or a Kv100C of from 2 cSt to 5 cSt.

In at least some examples of the present disclosure, the total concentration of isoprenoid compounds as defined herein in the lubricating composition of the present invention is at least 0.5 wt % based on the total weight of the lubricating composition. For example, the total concentration of isoprenoid compounds as defined herein may be at least 1 wt % of the total weight of the lubricating composition, or at least 5 wt %, or at least 10 wt %, or at least 20 wt %, or at least 30 wt %, or at least 40 wt %, or at least 50 wt %, or at least 60 wt %, or at least 70 wt % of the total weight of the lubricating composition as herein defined. In at least some examples of the present disclosure, the total concentration of isoprenoid compounds as defined herein in the lubricating composition of the present invention is up to 90 wt %, based on the total weight of the lubricating composition. For example, the total concentration of isoprenoid compounds as defined herein may be up to 85 wt %, or up to 80 wt %, or up to 75 wt %, based on the total weight of the lubricating composition.

The total concentration of isoprenoid compounds as defined herein in the base stock is suitably at least 10 wt %, for example at least 20 wt %, at least 30 wt %, at least 40 wt %, at least 50 wt %, at least 60 wt %, at least 70 wt %, at least 80 wt % or at least 90 wt % based on the total weight of the base stock. In at least some examples of the present disclosure, the total concentration of isoprenoid compounds as defined herein, in the base stock is up to 95 wt %, for example up to 98 wt % or up to 99 wt %. Thus, the base stock may consist only of isoprenoid compounds as defined herein.

In at least some examples, the base stock comprises two or more isoprenoid compounds as defined herein, for example three or more isoprenoid compounds as defined herein. For example, in at least some examples, the base stock contains two or more isoprenoid compounds wherein the two or more isoprenoid compounds exhibit different viscosity. Thus, the viscosity properties of the base stock may be adjusted.

In at least some examples of the present disclosure, the base stock exhibits a Kv40C of 70 cSt or less, for example a Kv40C of 50 cSt or less, or a Kv40C of 40 cSt or less, or a Kv40C of 30 cSt or less, or a Kv40C of 20 cSt or less.

In at least some examples of the present disclosure, the base stock exhibits a Kv100C of from 2 cSt to 18 cSt, for example Kv100C of from 2 cSt to 14 cSt, or a Kv100C of from 2 cSt to 10 cSt, or a Kv100C of from 2 cSt to 8.5 cSt, or a Kv100C of from 2 cSt to 8 cSt, or a Kv100C of from 2 cSt to 7 cSt, or a Kv100C of from 2 cSt to 6 cSt, or a Kv100C of from 2 cSt to 5 cSt.

In at least some examples the base stock is an aqueous base stock or is a non-aqueous base stock. Suitably, the base stock is a non-aqueous base stock.

In at least some examples, the base stock contains one or more isoprenoid compounds as defined herein, wherein at least one of the isoprenoid compounds is derived from a biological source, for example by a microbiological process for conversion of sugar(s) or glycerol to isoprenoid compound/compounds by treatment with microorganisms, for example by treatment with microorganisms adapted to produce the isoprenoid compound or precursor thereof. In particular examples, at least one of the isoprenoid compounds is derived from a biological source of farnesene or farnesol or combinations thereof.

In at least some examples the base stock contains at least 25% by weight biobased carbon, for example at least 32% by weight biobased carbon or at least 47% by weight biobased carbon. In at least some examples the base stock contains at least 25%, or at least 32% or at least 47%, by weight biobased carbon present as one or more isoprenoid compounds as defined herein. Methods of measuring biobased carbon content include those described in US Federal Register Vol. 78, no. 112 Tuesday June 11 p 34867 7 CFR Part 3201 final rule including for example 3201.102, including for example as specified in the applicable section of subpart B of part 2902 and as defined in ASTM Method D6866 "Standard Test Methods for Determining the Biobased Content of Natural Range Materials Using Radiocarbon and Isotope Ratio Mass Spectroscopy Analysis".

In at least some examples, the base oil of lubricating viscosity additionally comprises one or more base stocks other than the isoprenoid base stocks defined herein. For example, base stocks suitable for use in the base oil of the lubricating composition of the invention include one or more additional basestock selected from Group I, Group II, Group III, Group IV and Group V base stocks, and mixtures thereof.

Thus, according to a further aspect of the present disclosure there is provided a base oil for a lubricating composition which base oil comprises a first base stock comprising or consisting of at least one isoprenoid compound as defined herein and one or more additional base stocks selected from Group I, Group II, Group III, Group IV and Group V base stocks and mixtures thereof.

Suitable isoprenoid compounds in accordance with this aspect of the disclosure include those described herein in relation to the lubricating compositions of the present invention.

Suitable first base stocks in accordance with this aspect of the disclosure include base stocks comprising or consisting of at least one isoprenoid compound described herein in relation to the lubricating oil composition of the present invention.

In at least some examples of the present disclosure the base oil contains, at least 10 wt %, for example, at least 20 wt % of the base stock as defined herein, or at least 30 wt %, or at least 40 wt %, or at least 50 wt %, or at least 60 wt %, or at least 70 wt %, or at least 80 wt %, or at least 90 wt % of a base stock which comprises or consists of at least one isoprenoid compound as herein defined. In at least some examples of the present disclosure, the base oil comprises up to 95 wt %, for example up to 98 wt % or up to 99 wt % of the base stock as defined herein.

In at least some examples the base oil contains at least 25% by weight biobased carbon, for example at least 32% by weight biobased carbon or at least 47% by weight biobased carbon. In at least some examples the base oil contains at least 25%, or at least 32% or at least 47%, by weight biobased carbon present as one or more isoprenoid compounds as defined herein. Methods of measuring biobased carbon content include those described in US Federal Register Vol. 78, no. 112 Tuesday June 11 p 34867 7 CFR Part 3201 final rule including for example 3201.102, including for example as specified in the applicable section of subpart B of part 2902 and as defined in ASTM Method D6866 "Standard Test Methods for Determining the Biobased Content of Natural Range Materials Using Radiocarbon and Isotope Ratio Mass Spectroscopy Analysis".

In at least some examples of the present disclosure, the base oil exhibits a Kv40C of 700 or less, for example, a Kv40C of 50 or less or a Kv40C of 40 or less, or a Kv40C of 30 or less, or a Kv40C of 20 or less.

In at least some examples of the present disclosure, the base oil exhibits a Kv100C of from 2 to 18, for example Kv100C of from 2 to 14, or a Kv100 of from 2 to 10, or a Kv100C of from 2 to 8.5, or a Kv100C of from 2 to 8, or a Kv100C of from 2 to 7, or a Kv100C of from 2 to 6, or a Kv100C of from 2 to 5.

In at least some examples the base oil is an aqueous base oil or is a non-aqueous base oil. Suitably, the base oil is a non-aqueous base oil.

The lubricating composition of the invention suitably comprises a major amount of base oil and a minor amount of one or more lubricant additives. Major amount means at least 50% by weight, for example greater than 50% by weight. Minor amount means less than 50% by weight.

In another aspect, the present invention provides a method of preparing a lubricating composition as defined herein, comprising the step of combining a major amount of abase oil of lubricating viscosity and a minor amount of at least one lubricant additive, wherein the base oil comprises or consists of a base stock comprising one or more isoprenoid compounds as defined herein.

Major amount means at least 50% by weight, for example greater than 50% by weight. Minor amount means less than 50% by weight.

In at least some examples the lubricating composition is an aqueous lubricating composition or is a non-aqueous lubricating composition. Suitably, the lubricating composition is a non-aqueous lubricating composition.

Suitable lubricant additives for the lubricating composition and/or for the method of preparing a lubricating composition include detergents (including metallic and non-metallic detergents), friction modifiers, dispersants (including metallic and non-metallic dispersants), viscosity modifiers, dispersant viscosity modifiers, viscosity index improvers, pour point depressants, anti-wear additives, rust inhibitors, corrosion inhibitors, antioxidants (sometimes also called oxidation inhibitors), anti-foams (sometimes also called anti-foaming agents), seal swell agents (sometimes also called seal compatibility agents), extreme pressure additives (including metallic, non-metallic, phosphorus containing, non-phosphorus containing, sulphur containing and non-sulphur containing extreme pressure additives), surfactants, demulsifiers, anti-seizure agents, wax modifiers, lubricity agents, anti-staining agents, chromophoric agents, metal deactivators, and mixtures of two or more thereof.

In at least some examples, the at least one lubricant additive includes at least one detergent. Examples of detergents include ashless detergents (that is, non-metal containing detergents) and metal-containing detergents. Suitable non-metallic detergents are described for example in U.S. Pat. No. 7,622,431. Metal-containing detergents comprise at least one metal salt of at least one organic acid, which is called soap or surfactant. Suitable organic acids include for example, sulphonic acids, phenols (suitably sulphurised and including for example, phenols with more than one hydroxyl group, phenols with fused aromatic rings, phenols which have been modified for example, alkylene bridged phenols, and Mannich base-condensed phenols and saligenin-type phenols, produced for example by reaction of phenol and an aldehyde under basic conditions) and sulphurised derivatives thereof, and carboxylic acids including for example, aromatic carboxylic acids (for example hydrocarbyl-substituted salicylic acids and derivatives thereof, for example hydrocarbyl substituted salicylic acids and sulphurised derivatives thereof).

In at least some examples, the at least one lubricant additive includes at least one friction modifier. Suitable friction modifiers include for example, ash-producing additives and ashless additives. Examples of suitable friction modifiers include fatty acid derivatives including for example, fatty acid esters, amides, amines, and ethoxylated amines. Examples of suitable ester friction modifiers include esters of glycerol for example, mono-, di-, and tri-oleates, mono-palmitates and mono-myristates. A particularly suitable fatty acid ester friction modifier is glycerol monooleate. Examples of suitable friction modifiers also include molybdenum compounds for example, organo molybdenum compounds, molybdenum dialkyldithiocarbamates, molybdenum dialkylthiophosphates, molybdenum disulphide, trimolybdenum cluster dialkyldithiocarbamates, non-sulphur molybdenum compounds and the like. Suitable molybdenum-containing compounds are described for example, in EP 1533362 A1 for example in paragraphs [0101] to [0117].

In at least some examples, the at least one lubricant additive includes at least one dispersant. Examples of suitable ashless dispersants include oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons containing polyamine moieties attached directly thereto; Mannich condensation products formed by condensing a long chain substituted phenol with formaldehyde and polyalkylene polyamine; Koch reaction products and the like.

In at least some examples, the at least one lubricant additive includes at least one dispersant viscosity modifiers. Examples of suitable dispersant viscosity modifiers and methods of making them are described in WO 99/21902, WO2003/099890 and WO2006/099250.

In at least some examples, the at least one lubricant additive includes at least one viscosity index improver. Examples of suitable viscosity modifiers include high molecular weight hydrocarbon polymers (for example polyisobutylene, copolymers of ethylene and propylene and higher alpha-olefins); polyesters (for example polymethacrylates); hydrogenated poly(styrene-co-butadiene or isoprene) polymers and modifications (for example star polymers); and esterified poly(styrene-co-maleic anhydride) polymers. Oil-soluble viscosity modifying polymers generally exhibit number average molecular weights of at least 15000 to 1000000, preferably 20000 to 600000 as determined by gel permeation chromatography or light scattering methods.

In at least some examples, the at least one lubricant additive includes at least one pour point depressant. Examples of suitable pour point depressants include $C_8$ to $C_{18}$ dialkyl fumarate/vinyl acetate copolymers, methacrylates, polyacrylates, polyarylamides, polymethacrylates, polyalkyl methacrylates, vinyl fumarates, styrene esters, condensation products of haloparaffin waxes and aromatic compounds, vinyl carboxylate polymers, terpolymers of dialkyfumarates, vinyl esters of fatty acids and allyl vinyl ethers, wax naphthalene and the like.

In at least some examples, the at least one lubricant additive includes at least one anti-wear additive. Examples of suitable anti-wear additives include non-phosphorus containing additives for example, sulphurised olefins. Examples of suitable anti-wear additives also include phosphorus-containing antiwear additives. Examples of suitable ashless phosphorus-containing anti-wear additives include trilauryl phosphite and triphenylphosphorothionate and those disclosed in paragraph [0036] of US2005/0198894. Examples of suitable ash-forming, phosphorus-containing anti-wear additives include dihydrocarbyl dithiophosphate metal salts. Examples of suitable metals of the dihydrocarbyl dithiophosphate metal salts include alkali and alkaline earth metals, aluminium, lead, tin, molybdenum, manganese, nickel, copper and zinc. Particularly suitable dihydrocarbyl dithiophosphate metal salts are zinc dihydrocarbyl dithiophosphates (ZDDP).

In at least some examples, the at least one lubricant additive includes at least one rust inhibitor. Examples of suitable rust inhibitors include non-ionic polyoxyalkylene polyols and esters thereof, polyoxyalkylene phenols, polyoxyalkylene polyols, anionic alky sulphonic acids, zinc dithiophosphates, metal phenolates, basic metal sulphonates, fatty acids and amines.

In at least some examples, the at least one lubricant additive includes at least one corrosion inhibitor. Examples of corrosion inhibitors include phosphosulphurised hydrocarbons and the products obtained by the reaction of phosphosulphurised hydrocarbon with an alkaline earth metal oxide or hydroxide, non-ionic polyoxyalkylene polyols and esters thereof, polyoxyalkylene phenols, thiadiazoles, triazoles and anionic alkyl sulphonic acids. Examples of suitable epoxidised ester corrosion inhibitors are described in US2006/0090393.

In at least some examples, the at least one lubricant additive includes at least one antioxidant. Examples of suitable antioxidants include alkylated diphenylamines, N-alkylated phenylenediamines, phenyl-α-naphthylamine, alkylated phenyl-α-naphthylamines, dimethylquinolines, trimethyldihydroquinolines and oligomeric compositions derived therefrom, hindered phenolics (including ashless (metal-free) phenolic compounds and neutral and basic metal salts of certain phenolic compounds), aromatic amines (including alkylated and non-alkylated aromatic amines), sulphurised alkyl phenols and alkali and alkaline earth metal salts thereof, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds (for example, copper dihydrocarbyl thio- or thio-phosphate, copper salts of a synthetic or natural carboxylic acids, for example a $C_8$ to $C_{18}$ fatty acid, an unsaturated acid or a branched carboxylic acid, for example basic, neutral or acidic $Cu^I$ and/or $Cu^{II}$ salts derived from alkenyl succinic acids or anhydrides), alkaline earth metal salts of alkylphenolthioesters, suitably containing $C_5$ to $C_{12}$ alkyl side chains, calcium nonylphenol sulphide, barium t-octylphenyl sulphide, dioctylphenylamine, phosphosulphised or sulphurised hydrocarbons, oil soluble phenates, oil soluble sulphurised phenates, calcium dodecylphenol sulphide, phosphosulphurised hydrocarbons, sulphurised hydrocarbons, phosphorus esters, low sulphur peroxide decomposers and the like.

In at least some examples, the at least one lubricant additive includes at least one antifoam. Examples of suitable anti-foam agents include silicones, organic polymers, siloxanes (including poly siloxanes and (poly) dimethyl siloxanes, phenyl methyl siloxanes), acrylates and the like.

In at least some examples, the at least one lubricant additive includes at least one seal swell agent. Examples of suitable seal swell agents include long chain organic acids, organic phosphates, aromatic esters, aromatic hydrocarbons, esters (for example butylbenzyl phthalate) and polybutenyl succinic anhydride.

According to the US Federal Register Vol. 78, no. 112 Tuesday June 11 p 34867 7 CFR Part 3201 final rule for example 3201.102, engine crankcase oil (that is lubricating compositions suitable for lubricating internal combustion engine crankcases) may be designated with a biopreferred ecolabel if they contain at least 25% by weight biobased carbon and water turbine bearing oils may be designated with a biopreferred ecolabel if they contain at least 46% by weight biobased carbon.

A base oil that contains at least 32% by weight biobased carbon will produce a lubricating composition containing at least 25% by weight biobased carbon when prepared to contain 20% by weight lubricant additives. A base oil that contains at least 47% by weight biobased carbon will produce a lubricating composition containing at least 46% by weight biobased carbon when prepared to contain 2% by weight lubricant additives.

In at least some examples the lubricating composition contains at least 25% by weight biobased carbon, for example at least 32% by weight biobased carbon or at least 46% by weight biobased carbon. In at least some examples the lubricating composition contains at least 25%, or at least 32% or at least 46%, by weight biobased carbon present as one or more isoprenoid compounds as defined herein. In at least some examples the lubricating composition is a crankcase lubricating oil and contains at least 25% by weight biobased carbon, for example present as one or more isoprenoid compounds as defined herein. In at least some examples the lubricating composition is a water turbine bearing oil and contains at least 46% by weight biobased carbon, for example present as one or more isoprenoid compounds as defined herein. Methods of measuring biobased carbon content include those described in US Federal Register Vol. 78, no. 112 Tuesday June 11 p 34867 7 CFR Part 3201 final rule including for example 3201.102, including for example as specified in the applicable section of subpart B of part 2902 and as defined in ASTM Method D6866 "Standard Test Methods for Determining the Biobased Content of Natural Range Materials Using Radiocarbon and Isotope Ratio Mass Spectroscopy Analysis".

According to another aspect of the present disclosure there is provided a method of lubricating a surface which comprises applying to said surface a lubricating composition as herein defined and/or prepared by a method as herein defined.

Suitable surfaces include those in power transmission systems for example drive lines and gear boxes for example for vehicles including for example passenger vehicles and heavy duty vehicles; and those in internal combustion engines, for example the crankcases of internal combustion engines. Suitable surfaces also include those in turbine bearings for example in water turbine bearings.

Suitable internal combustion engines include, for example, engines used in automotive applications, engines used in marine applications and engines used in land-based power generation plants.

In at least some examples, the lubricating composition of the invention is used to lubricate the crankcase of an internal combustion engine at any temperature which is typically encountered in an engine environment, for example a temperature in the range of ambient to 250° C., e.g. 90 to 120° C. Typically, ambient temperature is 20° C., but according to at least some embodiments, ambient temperature is for example less than 20° C., for example 0° C.

In a further aspect, the present invention provides the use as a component of a base stock for a lubricating composition of at least one isoprenoid compound comprising:

(i) one or two oxygen-containing moieties independently selected from ether and ester moieties;

(ii) a first acyclic isoprenoid moiety containing 1 to 5 isoprenyl units; and (iii) optionally, a second acyclic isoprenoid moiety containing 1 to 5 isoprenyl units with the proviso that at least one isoprenoid moiety contains 3 to 5 isoprenyl units where the isoprenoid compound contains a single ether moiety.

Suitable isoprenoid compounds in accordance with this aspect of the invention include those described herein in relation to the base stocks, base oils or lubricating compositions of the invention. Thus, in at least some examples the at least one isoprenoid compound is selected from the compounds represented by formulae (1) to (8) described herein. Suitable compounds represented by formulae (1) to (8) that are described herein in relation to the base stocks, base oils or lubricating compositions of the invention are also suitable in accordance with this aspect of the invention.

Suitable base stocks include those described herein including aqueous base stocks and non-aqueous base stocks. Suitably, the base stock is a non-aqueous base stock.

The present invention will now be described by reference to the following examples. The examples are merely illustrative and shall not be interpreted as in any way limiting the scope of protection as defined in the claims.

Example 1—Synthesis of n-Alkyl Ethers of Farnesene Represented by Formula (9)

Alkyl ethers of farnesene represented by formula (9) were prepared by dissolving the n-alkyl alcohol (1 eq.) in tetrahydrofuran (15 vol. eq.) and warming to 30° C. to aid dissolution. Sodium hydride (1.5 eq.) was added portion wise to the solution over 15 minutes. The reaction mixture was then warmed to reflux and stirred for 30 minutes. Farnesyl bromide (1 eq.) was then added over 15 minutes maintaining reflux. The reaction mixture was held at reflux for greater than 5 hours or overnight. The reaction mixture was quenched onto saturated aqueous ammonium chloride solution and extracted into ethyl acetate. The ethyl acetate extracts were combined and washed with brine. The extract was dried with $MgSO_4$, filtered through celite and concentrated to dryness giving, a yellow oil, which solidified on cooling. The crude product was purified by passing through a silica plug eluted with 50% DCM (dichloromethane) in heptanes to give a colourless liquid after solvent removal.

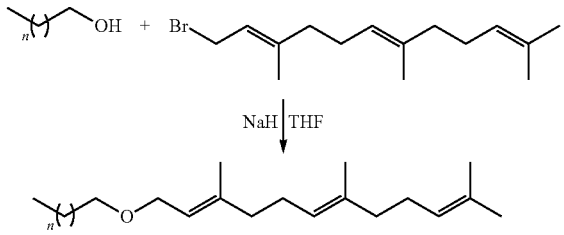

Example 2—Synthesis of Hydrogenated n-Alkyl Ethers of Farnesene Represented by Formula (10)

The ether produced according to the procedure of Example 1 (1 eq.) was charged to an autoclave with heptane (10 vol. eq.) and 5% Pt/C (10 wt %). The autoclave was sealed, placed in an ice water bath and the contents stirred. When the contents had cooled to 5° C. the autoclave was charged with hydrogen (20 atm). The reaction was allowed to warm slowly to room temperature overnight. $^1H$ NMR analysis of the reaction showed that starting material had been consumed. The reaction mixture was filtered through celite washing the filter-cake with heptane. The heptane mother liquors were concentrated to give a crude product containing some cleaved ether by-products. Purification was performed using silica chromatography to obtain a colourless liquid product comprising hydrogenated n-alkyl ether of farnesene as represented by formula (10).

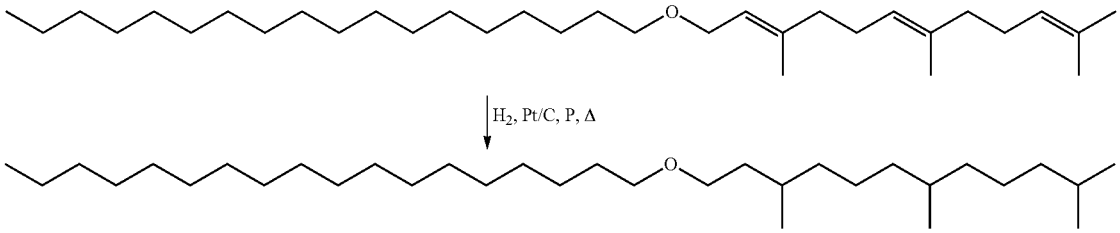

Example 3—Synthesis of Farnesyl Oleate (12)

Farnesyl oleate which may be represented by formula (12), was prepared from oleic acid via conversion of oleic acid to the corresponding acid chloride and reaction with farnesol. Oleic acid (1 eq) was dissolved in toluene and warmed to 70-80° C. Thionyl chloride (1.5 eq.) was added drop wise to the reaction mixture over 30 minutes. The reaction mixture was held at 70-80° C. for 3 hours and then cooled. Toluene and excess thionyl chloride were removed under vacuum to provide the crude acid chloride in quantitative yield. The crude acid chloride (1.2 eq.) was dissolved in toluene. and a solution of farnesol (1.0 eq.) and triethylamine (1.5 eq.) in toluene was added over 30 minutes. The reaction mixture was stirred at 40° C. for 3 hours. In process $^1$H NMR analysis showed virtually all the farnesol had been consumed and an ester had formed. The reaction mixture was allowed to cool to room temperature and then quenched into water. Brine was added to aid separation of the aqueous and organic layers. The toluene layer was collected, dried with $MgSO_4$ and concentrated to give the crude product as a yellow liquid. Impurities were removed by eluting through a silica gel plug with hexane then 5% dichloromethane in hexane to give a colourless liquid after removal of solvents.

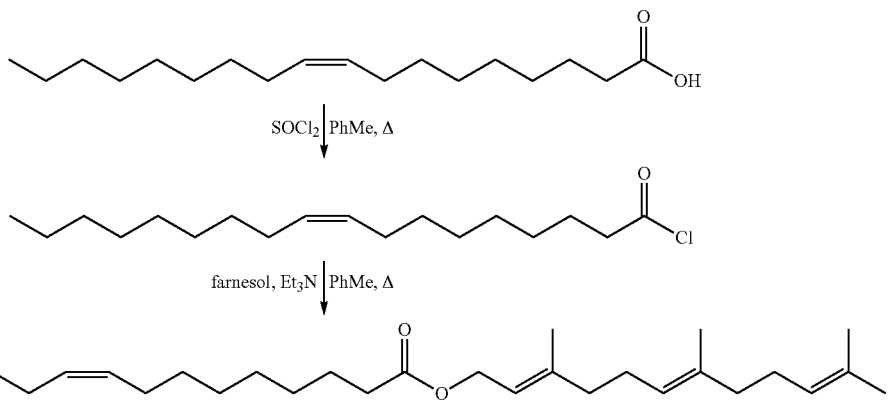

Example 4—Synthesis of Difarnesyl Ether (13)

Difarnesyl ether which may be represented by formula (13), was prepared by reaction of farnesol with farnesyl bromide in the presence of sodium hydride and tetrahydrofuran solvent. Farnesol (1.0 eq.) was dissolved in tetrahydrofuran and 60% sodium hydride (1.5 eq.) was added over 15 minutes. The mixture was warmed to 50° C. and stirred for 30 minutes. 86% Farnesyl bromide (1.0 eq.) was added over 10 minutes and stirred at 50° C. overnight. The reaction was quenched into aqueous ammonium chloride solution and extracted into ethyl acetate. The extracts were washed with brine and concentrated to give a crude product. The crude material was purified by passing through a silica plug to give a colourless oil after removal of solvents.

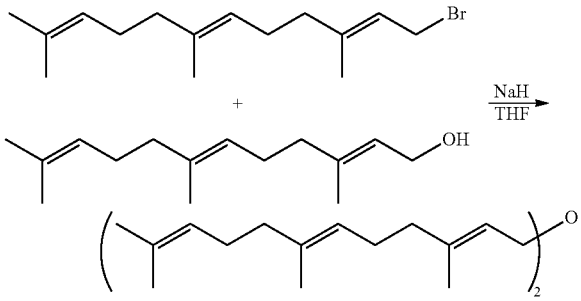

Example 5—Synthesis of Hydrogenated Difarnesyl Ether (14)

The hydrogenated difarnesyl ether which may be represented by formula (14) was produced by hydrogenating the ether prepared according to the procedure of Example 4 (1 eq.) by charging it to an autoclave with heptane (10 vol. eq.) and 5% Pt/C (10 wt %). The autoclave was sealed, placed in an ice water bath and the contents stirred. When the contents had cooled to 5° C. the autoclave was charged with hydrogen (10 atm). The reaction was allowed to warm slowly to room temperature overnight. $^1$H NMR analysis of the reaction showed that starting material had been consumed. The reaction mixture was filtered through celite washing the filter-cake with heptane. The heptane mother liquors were concentrated to give a crude product containing some cleaved ether by-products. Purification was performed using silica chromatography to obtain a colourless liquid product.

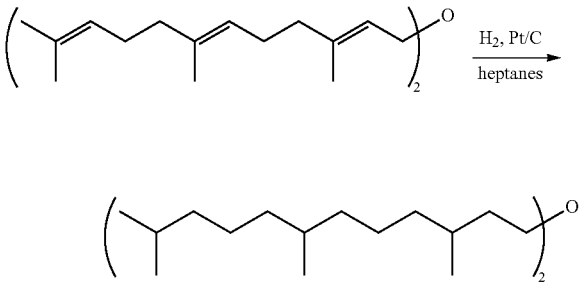

Example 6—Synthesis of furan-2,5-dicarboxylic Acid Difarnesyl Ester (21)

Furan-2,5-dicarboxylic acid difarnesyl ester (also called difarnesyl-furan-2,5-dicarboxylate), which is a diester which may be represented by formula (21), was prepared via conversion of furan-2,5-dicarboxylic acid to the corresponding diacid chloride followed by reaction with farnesol. Furan-2,5-dicarboxylic acid (1 eq.) was slurried in toluene (10 vol. eq.) and thionyl chloride (2.5 eq.), dimethyl formamide (0.05 eq) was added and the mixture was heated to 80° C. overnight. When $^1$H NMR analysis showed that the reaction had gone to completion, the reaction mixture was concentrated under vacuum to provide the diacid chloride as an off-white solid. The diacid chloride (1.0 eq) was dissolved in toluene (10.) without further purification, and a solution of farnesol (2.0 eq.) in toluene (10.) and triethylamine (2.5 eq.) was added over 30 minutes. Ice/water cooling was applied to maintain the reaction temperature at 30° C. The reaction mixture was then stirred at 25° C. for 2 hours. When $^1$H NMR analysis showed that esterification was complete, the reaction mixture was quenched into brine and the product extracted into toluene. The toluene extracts were dried with $MgSO_4$, filtered through celite and concentrated to dryness. The crude product was then purified by passing through a silica plug and eluting with 75% dichloromethane in hexane to provide a colourless liquid product.

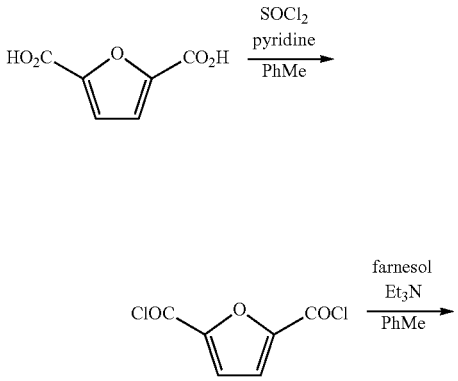

-continued

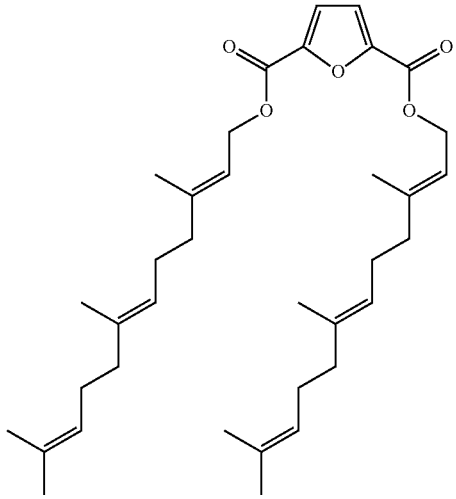

Example 7—Hydrogenated furan-2,5-dicarboxylic Acid Difarnesyl Ester (22)

The hydrogenated diester (hydrogenated furan-2,5-dicarboxylic acid difarnesyl ester also called hydrogenated difarnesyl-furan-2,5-dicarboxylate) which may be represented by formula (22) was prepared by hydrogenation. The diester represented by formula (21) (1 eq.) which had been produced according to the procedure of Example 6, was charged to an autoclave with ethyl acetate (10.) and 5% Pt/C (10 wt %). The autoclave was sealed, charged with hydrogen (20 atm), and stirred overnight at room temperature. $^1$H NMR analysis of the reaction showed that starting material had been consumed. The reaction mixture was filtered through celite washing the filter-cake with ethyl acetate. The ethyl acetate mother liquors were concentrated to give a crude product containing some cleaved ether by-products. Purification was performed using silica chromatography to obtain a colourless liquid product.

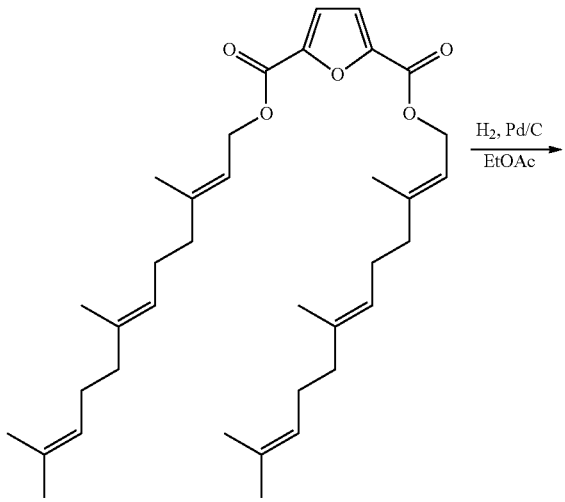

-continued

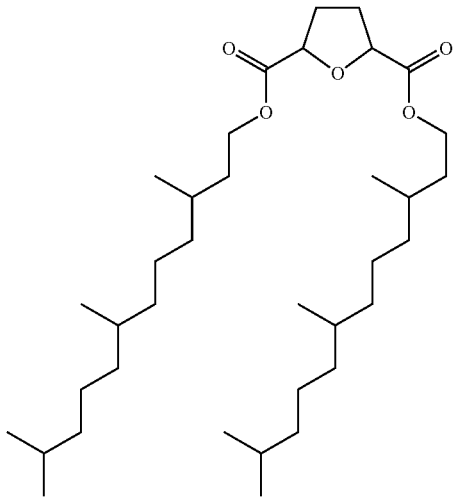

Example 8—Synthesis of Hydrogenated Difarnesyl Terephthalate (23)

Hydrogenated difarnesyl terephthalate (also called hydrogenated difarnesyl terephthalate) which may be presented by formula (23) was prepared by the reaction of hydrogenated farnesol with terephthaloyl chloride. Terephthaloyl chloride (1.0. eq.) was dissolved in dichloromethane with excess triethylamine, excess hydrogenated farnesol and pyridine, and the resulting mixture was heated to reflux overnight. After removal of solvents, the crude material was purified by flash chromatography with heptanes to give a 3:2 mixture of difarnesyl terephthalate (23) and hydrogenated farnesene (by GC). The mixture was distilled under vacuum to remove the alkane to provide the difarnesyl terephthalate product as a yellow liquid.

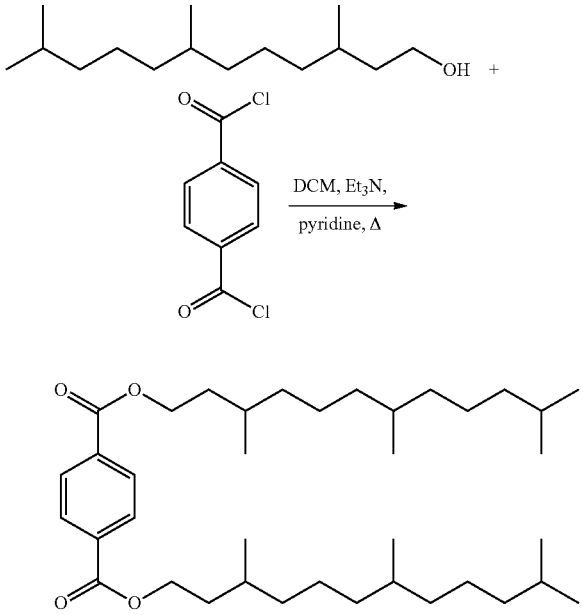

Example 9—Synthesis of Compound Represented by Formulae (11) and (19)

The compound represented by formula (19)

(19)

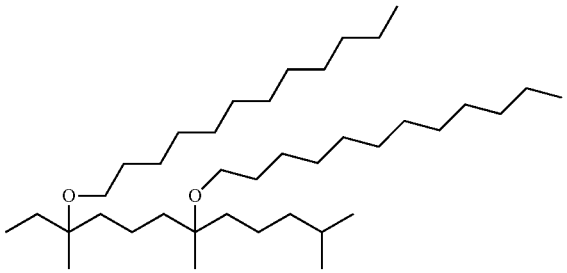

was produced, it is believed, during the acid catalysed formation of a compound represented by formula (11):

(11)

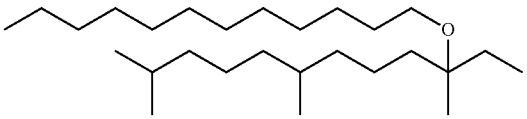

It is believed that this material is a mixture of isomers with different connectivity which is non-terminal. This is supported by proton NMR analysis. This conclusion is based upon the evidence that the viscosity of the mixture resulting from the reaction is appreciably thicker than the mono-ether that was formed. The method of preparation was:

Farnesene (40.8 g, 20.0 mmol, 1.0 eq) was combined with lauryl alcohol (37.2 g, 20.0 mmol, 1.0 eq.) and Ambelyst 15 (4.08 g, 10 wt %). The mixture was heated to 65° C. and stirred overnight. The reaction mixture was diluted with heptane (200 mL) and filtered through celite. This crude reaction mixture was hydrogenated in the presence of 5% Pt/C catalyst under an atmosphere of hydrogen (30 atm) initially 0° C.-20° C. and then 50° C. to drive the reduction to completion. The reaction mixture was filtered through celite and concentrated to give a colourless oil 75 g. The crude product was placed under a high vacuum (<1 mbar), and heated in an oil bath to remove any volatile materials (180° C. head temp). After all volatiles were removed 20.0 g of residue remained as a colourless oil (25.6% yield over two chemistry steps).

Example 10—Properties of Isoprenoid Compounds

Isoprenoid compounds of formulae (9) to (23) were tested for the following key lubricant properties:

Kinematic viscosity at 40° C. and 100° C. (ASTM D445)

Viscosity Index (ASTM D2270)

Pour Point (ASTM D7346)

Volatility (IP 393: Determination of volatility of automotive lubricating oils—Thermo-Gravimetric method)

The Thermo-Gravimetric Analysis simulation of the traditional Noack test was conducted due to limited sample available for testing (the traditional Noack test requires around 50 ml of sample). 15 mg of sample was loaded into a platinum sample pan and suspended from a micro-balance.

The suspended pan containing the sample was then positioned inside a furnace and heated at a constant rate under flowing nitrogen gas. The result was calculated relative to a reference oil of known volatility that was run before and after the sample. For example, a reference compound of Noack volatility 12.5% is heated and the temperature at which its mass falls to 87.5% recorded. The target sample was then analysed to determine its mass loss at this temperature.

The results are shown in Table 2 (optimum values are included in parentheses) together with comparative results obtained using SKYubase 4 (a commercially-available Group III base stock).

TABLE 2

| Compound represented by formula: | KV100/ cSt | KV40/ cSt | VI | Pour Point/ ° C. | TGA Noack/ % |
|---|---|---|---|---|---|
| 9 (n = 10) | 2.4 | 6.6 | 202 | −45 | 20 |
| 9 (n = 12) | 2.7 | 8.2 | 202 | −24 | 10 |
| 9 (n = 16) | 3.7 | 16 | 124 | 6 | 5 |
| 10 (n = 10) | 2.8 | 9.4 | 155 | −39 | 20 |
| 10 (n = 12) | 3.7 | 14 | 156 | −18 | 6 |
| 10 (n = 16) | 4.2 | 17 | 167 | 9 | 3 |
| 12 | 3.8 | 14 | 182 | −30 | 3 |
| 13 | 2.7 | 10 | 116 | −81 | 26 |
| 14 | 3.5 | 14 | 131 | −75 | 12 |
| 21 | 8.9 | 63 | 116 | −45 | 59 (decomposed) |
| 22 | 6.3 | 38 | 116 | −54 | 5 |
| 23 | 9.2 | 70 | 106 | −48 | 2 |
| Yubase 4 | 4.2 | 19 | 125 | −15 | 13 |

These results demonstrate that all of the tested compounds exhibit kinematic viscosity values that make them potentially suitable for blending into automotive crankcase lubricants. All of the tested compounds exhibit viscosity indexes in the target range (>100) and many exhibit viscosity indexes above 140.

Most of the tested compounds exhibit pour points below −10° C., and many exhibit pour points in a preferred range below −25° C. For formulation into lubricants, pour point depressants may be used to adjust the pour point if necessary. In general, the pour point was found to increase with saturation.

Volatility measured by simulated Noack on TGA gave good results for most compounds, especially compared to conventional base oils of comparable viscosity. The high value for compound 21 is attributed to thermal decomposition of the material during the test, rather than a true measurement of volatility.

The tested compounds all compare favourably with Yubase 4.

Generally, the data support an observation that isoprenoid compounds with saturated isoprenoid moieties exhibit longer oxidative induction times and/or higher oxidation ignition temperatures. Thus, these compounds are generally more oxidative stable.

Example 11—Aniline Point

The aniline point of each compound of formula (10) [n=10] and (14) was determined according to ASTM D611. The aniline point is an indication of the polarity of the compounds and their propensity to cause seal swelling. Lower values indicate that the material is more polar and more likely to cause significant swelling of elastomeric seals. The results are shown in Table 3, together with comparative results obtained for Yubase 4.

TABLE 3

| Compound represented by formula: | Aniline Point/ ° C. | Mixed Aniline Point/ ° C. |
|---|---|---|
| 10 (n = 10) | 82.2 | 74.3 |
| 14 | 99.3 | 88.5 |
| Yubase 4 | 116.0 | 95.2 |

The results obtained compare favourably with Yubase 4, and suggest that the compounds will not cause seal swelling problems.

Example 12—Deposit Testing

The TEOST MHT deposit bench test (ASTM D 7097) is designed to predict the deposit forming tendencies of engine oil in the piston ring belt and upper piston crown area. The test was run in duplicate on a formulated engine oil comprising 50 wt % of test compound, 10.21 wt % of an additive pack, 0.5 wt % of anti-wear additive, 6 wt % of viscosity modifier, 32.99 wt % of Yubase 4, and 0.2 wt % of pour point depressant.

The additive pack composition contained dispersant, calcium sulphonate and phenate detergents, antioxidants and anti-foam.

The results are shown in Table 4, together with comparative results obtained for a lubricating composition with all the base oil being Yubase 4.

TABLE 4

| Compound represented by formula: | Test 1 Deposits/ mg | Test 2 Deposits/ mg | Average Deposits/ mg |
|---|---|---|---|
| 10 (n = 10) | 65.5 | 65.1 | 65.3 |
| 14 | 58.3 | 65.1 | 61.7 |
| Yubase 4 | 84.8 | 80.8 | 82.8 |

The test compounds significantly outperformed Yubase 4, demonstrating very low deposit forming tendency of the test compounds.

Example 13—High Temperature Corrosion Bench Test (HTCBT)

The test was run in accordance with ASTM D6594, which evaluates the corrosiveness of diesel engine oil at 135° C. and is intended to simulate the corrosion process of non-ferrous metals exposed to engine oil. For instance, copper is present in the engine turbo bearings and oil cooler, whilst lead is present in the bearings of an engine.

The test was run on a formulated engine oil comprising 50 wt % of test compound, 10.21 wt % of an additive pack, 0.5 wt % of anti-wear additive, 6 wt % of viscosity modifier, 32.99 wt % of Yubase 4, and 0.2 wt % of pour point depressant.

The additive pack composition contained dispersant, calcium sulphonate and phenate detergents, antioxidants and anti-foam.

As part of the test, four metal coupons were immersed in hot oil (135° C.) for a period of seven days. At the end of this period, the levels of test metals dissolved in the oil were measured. The pass criteria for the HTCBT test is: Cu<20 ppm; Pb<120 ppm; copper strip rating of <3.

The results, including kinematic viscosity (ASTM D445) and total base number (TBN) measurements for the test oils following completion of the test, are shown in Table 5, together with comparative results obtained for a lubricating composition with all the base oil being Yubase 4.

TABLE 5

| Compound represented by formula: | Copper/ ppm | Lead/ ppm | Tin/ ppm | Copper rating | KV40 % change | KV100 % change | TBN D4739 change |
|---|---|---|---|---|---|---|---|
| 10 (n = 10) | 3 | 40 | 0 | 1b | −3 | −2 | −0.9 |
| 14 | 3 | 38 | 0 | 1b | −4 | −4 | −0.6 |
| Yubase 4 | 3 | 10 | 0 | 1b | −5 | −3 | −1.1 |

The results obtained compare favourably with Yubase 4; the test compounds passed each of the test criteria, suggesting that the compounds will not cause corrosion problems.

Example 14—Seals Testing

This test was run in accordance with industry standard method CEC L 39-T-96, except that, due to limited sample availability, only 100 g of oil (as opposed to 270 g used in the standard method) was used for testing.

The test was run on a formulated engine oil comprising 50 wt % of test compound, 10.21 wt % of an additive pack, 0.5 wt % of anti-wear additive, 6 wt % of viscosity modifier, 32.99 wt % of Yubase 4, and 0.2 wt % of pour point depressant.

The additive pack composition contained dispersant, calcium sulphonate and phenate detergents, antioxidants and anti-foam.

As part of the test, an ethylene acrylate rubber seal was immersed in the test oil for 168 hours at elevated temperature.

The results are shown in Table 6, together with comparative results obtained for a lubricating composition with all the base oil being Yubase 4. Lower and upper limit pass criteria of the test are also included in Table 6.

TABLE 6

| Compound represented by formula: | Tensile Strength/ % | Elongation Rupture/ % | Hardness | Volume variation/ % |
|---|---|---|---|---|
| Pass limits (lower/upper) | −15/18 | −35/10 | −5/8 | −7/5 |
| 12 | 1.7 | −10.3 | −4.6 | 4.7 |
| 10 (n = 10) | 7.8 | −24.8 | 0.8 | 1.0 |
| 14 | −2.4 | −29.0 | 5.9 | 1.3 |
| Yubase 4 | −1.3 | −27.9 | 1.6 | 0.4 |

The results obtained compare favourably with Yubase 4; the test compounds passed each of the test criteria, suggesting that the compounds will not cause seal swelling problems.

Example 15—Volatility Testing

The test was run in accordance with IP 393 (Determination of volatility of automotive lubricating oils—Thermo-Gravimetric method). The Thermo-Gravimetric Analysis simulation of the traditional Noack test was conducted substantially as reported in Example 10 using 15 mg samples. The test was run in duplicate on a formulated engine oil comprising 5 wt % of test compound, 10.21 wt % of an additive pack, 0.5 wt % of anti-wear additive, 6 wt % of viscosity modifier, 77.99 wt % of Yubase 4, and 0.3 wt % of pour point depressant.

The results are shown in Table 7 together with comparative results obtained using a formulated engine oil comprising 10.21 wt % of an additive pack, 0.5 wt % of anti-wear additive, 6 wt % of viscosity modifier, 82.99 wt % of Yubase 4, and 0.3 wt % of pour point depressant. Table 7 also includes results for kinematic viscosity measurements (ASTM D445) for the test oils.

TABLE 7

| Compound represented by formula: | KV40/ cSt | KV100/ cSt | TGA Noack/ % |
|---|---|---|---|
| 10 (n = 10) | 51.15 | 9.52 | 14.2 |
| 10 (n = 12) | 48.96 | 9.31 | 12.1 |
| 10 (n = 16) | 49.27 | 9.33 | 21.1 |
| Yubase 4 | 50.9 | 9.4 | 12.5 |

Volatility measured by simulated Noack on TGA gave good results for the test compounds, which compare favourably with Yubase 4. Moreover, the results of the test demonstrate that even at a low treat rate of 5 wt %, the test compounds provide oils with desirably low viscosity, without detrimentally impacting upon oil volatility. Thus, advantageously, test compounds can be used even at low concentrations to provide engine oils of both low viscosity and low volatility.

These results demonstrate that the tested compounds exhibit properties, for example kinematic viscosity values, that make them suitable for use as a component of a base stock for a lubricating composition and for blending into lubricating compositions suitable for use in a method of lubricating the crankcase of an internal combustion engine. Such lubricating compositions may be prepared by a method comprising the step of combining a major amount of a base oil of lubricating viscosity and a minor amount of at least one lubricant additive, wherein the base oil comprises or consists of a basestock as herein defined. Major amount means at least 50% by weight, for example greater than 50% by weight. Minor amount means less than 50% by weight.

What is claimed is:

1. A lubricating composition comprising:

(a) a base oil of lubricating viscosity comprising a base stock, wherein the base stock comprises at least one isoprenoid compound, wherein the isoprenoid compound comprises:

(i) one or two oxygen-containing moieties independently selected from ether and ester moieties; and (ii) a first acyclic isoprenoid moiety containing 1 to 5 isoprenyl units and wherein the isoprenoid compound optionally comprises (iii) a second acyclic isoprenoid moiety containing 1 to 5 isoprenyl units, with the proviso that at least one isoprenoid moiety contains 3 to 5 isoprenyl units where the isoprenoid compound contains a single ether moiety; and (b) one or more lubricant additives.

2. A lubricating composition according to claim 1 wherein the isoprenoid compound comprises:

(i) one or two oxygen-containing moieties independently selected from ether and ester moieties; and (ii) a first acyclic isoprenoid moiety containing 3 to 5 isoprenyl units; and wherein the isoprenoid compound optionally comprises (iii) a second acyclic isoprenoid moiety containing 1 to 5 isoprenyl units.

3. A lubricating composition according to claim 1, wherein the isoprenoid compound is represented by the formula (1), (2) or (3):

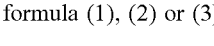

$$R^1—O-T^1 \quad (1)$$

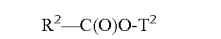

$$R^2—C(O)O-T^2 \quad (2)$$

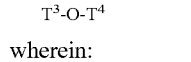

$$T^3-O-T^4 \quad (3)$$

wherein:

$R^1$ and $R^2$ each represent an acyclic unsubstituted hydrocarbyl group or an acyclic substituted hydrocarbyl group other than an acyclic, saturated or unsaturated, isoprenoid moiety containing from 1 to 5 isoprenyl units;

$T^1$ represents an acyclic, saturated or unsaturated, isoprenoid moiety containing from 3 to 5 isoprenyl units;

$T^2$ represents an acyclic, saturated or unsaturated, isoprenoid moiety containing from 1 to 5 isoprenyl units; and $T^3$ and $T^4$ each represent an acyclic, saturated or unsaturated, isoprenoid moiety containing from 1 to 5 isoprenyl units, with the proviso that at least one of $T^3$ and $T^4$ represents an acyclic, saturated or unsaturated, isoprenoid moiety containing from 3 to 5 isoprenyl units.

4. A lubricating composition according to claim 1, wherein the isoprenoid compound is represented by the formula (4), (5), (6), (7) or (8):

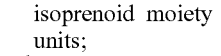

$$R^3—O—R^4—O-T^5 \quad (4)$$

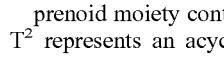

$$T^6-O—R^5—O-T^7 \quad (5)$$

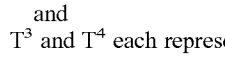

$$R^6—O-T^8-O—R^7 \quad (6)$$

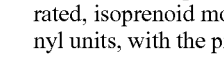

$$R^8—OC(O)—R^9—C(O)O-T^9 \quad (7)$$

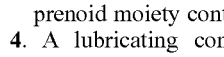

$$T^{10}-OC(O)—R^{10}—C(O)O-T^{11} \quad (8)$$

wherein:

$R^3$, $R^6$, $R^7$ and $R^8$ each independently represent an acyclic unsubstituted hydrocarbyl group or an acyclic substituted hydrocarbyl group other than an acyclic, saturated or unsaturated, isoprenoid moiety containing from 1 to 5 isoprenyl units;

$R^4$ and $R^5$ each independently represent a divalent, cyclic or acyclic hydrocarbyl group, other than a divalent acyclic, saturated or unsaturated, isoprenoid moiety containing from 1 to 5 isoprenyl units; or a heterocyclyl group;

$R^9$ and $R^{10}$ each independently represent a divalent, cyclic or acyclic hydrocarbyl group, other than a divalent acyclic, saturated or unsaturated, isoprenoid moiety containing from 1 to 5 isoprenyl units; a heterocyclyl group; or a covalent bond;

$T^8$ represents a divalent acyclic, saturated or unsaturated, isoprenoid moiety containing from 1 to 5 isoprenyl units; and $T^5$, $T^6$, $T^7$, $T^9$, $T^{10}$, $T^{11}$ and each independently represents an acyclic, saturated or unsaturated, isoprenoid moiety containing from 1 to 5 isoprenyl units.

5. A lubricating composition according to claim 3, wherein $T^1$, $T^2$, $T^3$, and $T^4$ each independently represents an acyclic, saturated or unsaturated, isoprenoid moiety containing 3, 4 or 5 isoprenyl units.

6. A lubricating composition according to claim 4, wherein $T^1$, $T^2$, $T^3$, and $T^4$, $T^5$, $T^6$, $T^7$, $T^9$, $T^{10}$, $T^{11}$ and each independently represents an acyclic, saturated or unsaturated, isoprenoid moiety containing 3, 4 or 5 isoprenyl units.

7. A lubricating composition according to claim 4, wherein $T^8$ represents a divalent acyclic, saturated or unsaturated, isoprenoid moiety containing 3, 4 or 5 isoprenyl units.

8. A lubricating composition according to claim 1, wherein the at least one isoprenoid compound exhibits a Kv40C of 70 cSt or less.

9. A lubricating composition according to claim 1, wherein the at least one isoprenoid compound exhibits a Kv100C of from 2 cSt to 18 cSt.

10. A lubricating composition according to claim 1, wherein the base stock comprises at least 10 wt % of the at least one isoprenoid compound.

11. A lubricating composition according to claim 1, wherein the base stock exhibits a Kv40C of 70 cSt or less.

12. A lubricating composition according to claim 1, wherein the base stock exhibits a Kv100C in the range of 2 to 18 cSt.

13. A lubricating composition according to claim 1, wherein the base oil further comprises one or more additional base stocks selected from the group consisting of Group I, Group II, Group III, Group IV and Group V base stocks, and mixtures thereof.

14. A base oil for a lubricating composition, the base oil comprising:

a first base stock comprising at least one isoprenoid compound, wherein the isoprenoid compound comprises:

(i) one or two oxygen-containing moieties independently selected from ether and ester moieties;

(ii) a first acyclic isoprenoid moiety containing 1 to 5 isoprenyl units; and (iii) optionally, a second acyclic isoprenoid moiety containing 1 to 5 isoprenyl units, with the proviso that at least one isoprenoid moiety contains 3 to 5 isoprenyl units where the isoprenoid compound contains a single ether moiety; and one or more additional base stocks selected from the group consisting of Group I, Group II, Group III, Group IV and Group V base stocks and mixtures thereof.

15. A base oil according to claim 14 which base oil exhibits a Kv40C of 70 cSt or less.

16. A base oil according to claim 14 which base oil exhibits a Kv100C in the range of 2 to 18 cSt.

17. A base oil according to claim 14, wherein the first base stock comprises at least 10 wt % of the at least one isoprenoid compound.

18. A method of preparing a lubricating composition as defined in claim 1, which method comprises the step of combining a major amount of a base oil of lubricating viscosity and a minor amount of at least one lubricant additive, wherein the base oil comprises a base stock comprising the at least one isoprenoid compound.

19. A method of lubricating a surface which comprises applying to said surface a lubricating composition according to claim 1.

20. A lubricating composition according to claim 1, wherein the isoprenoid compound is

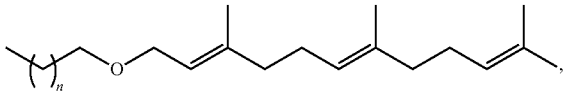

wherein n is 10, 12, 14, or 16.

21. A lubricating composition according to claim 1, wherein the isoprenoid compound is

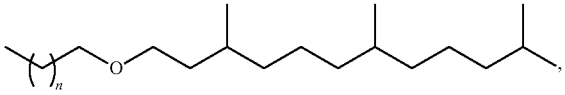

wherein n is 10, 12, 14, or 16.

22. A lubricating composition according to claim 1, wherein the isoprenoid compound is

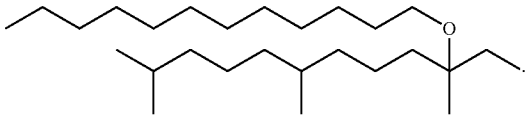

* * * * *